US011571612B2

(12) United States Patent
Tarrant

(10) Patent No.: US 11,571,612 B2
(45) Date of Patent: Feb. 7, 2023

(54) DIVOT TOOL AND METHOD OF MANUFACTURE THEREOF

(71) Applicant: Ryan Harland Tarrant, Fullerton, CA (US)

(72) Inventor: Ryan Harland Tarrant, Fullerton, CA (US)

(73) Assignee: Ryan Harland Tarrant, Fullerton, CA (US)

( * ) Notice: Subject to any disclaimer, the term of this patent is extended or adjusted under 35 U.S.C. 154(b) by 0 days.

(21) Appl. No.: 17/202,312

(22) Filed: Mar. 15, 2021

(65) Prior Publication Data

US 2021/0283475 A1 Sep. 16, 2021

Related U.S. Application Data

(60) Provisional application No. 62/989,184, filed on Mar. 13, 2020.

(51) Int. Cl.

| | |
|---|---|
| ***A63B 57/50*** | (2015.01) |
| ***A63B 60/06*** | (2015.01) |
| ***A63B 53/14*** | (2015.01) |
| *A63B 102/32* | (2015.01) |

(52) U.S. Cl.

CPC ..... *A63B 57/50* (2015.10); *A63B 53/14* (2013.01); *A63B 60/06* (2015.10); *A63B 2102/32* (2015.10)

(58) Field of Classification Search

CPC ..... A63B 57/50; A63B 53/14; A63B 60/06; A63B 2102/32

See application file for complete search history.

(56) References Cited

U.S. PATENT DOCUMENTS

| | | | | | |
|---|---|---|---|---|---|
| 3,771,794 | A * | 11/1973 | Crockett | A63B 57/50 | 473/286 |
| 4,787,632 | A * | 11/1988 | Nigrelli | A63B 47/02 | 294/19.2 |
| 4,925,190 | A * | 5/1990 | Learned | A63B 53/007 | 473/286 |
| 4,984,790 | A * | 1/1991 | Dowdy | A63B 57/50 | 473/408 |
| 5,277,425 | A * | 1/1994 | Petriano, Sr. | A01B 1/14 | 172/381 |
| 5,423,543 | A * | 6/1995 | Tarrant | A63B 57/50 | 473/286 |

(Continued)

FOREIGN PATENT DOCUMENTS

| | | | | |
|---|---|---|---|---|
| WO | WO-0057964 | A1 * | 10/2000 | A63B 57/50 |

*Primary Examiner* — Steven B Wong

(74) *Attorney, Agent, or Firm* — Shield Intellectual Property

(57) ABSTRACT

A divot repair tool for fixing divots in the playing surface made while playing golf. The tool is attached to the grip of a golf club and used to replace and fix divots in the grass. The club allows the tool to be extended to the ground without bending over or squatting down, thus reducing sports related injuries. The divot repair tool includes removable prongs and blade that can be used to fix the divot holes using a levering motion or a rotational motion. The divot repair tool can include an automated motorized embodiment that can rotate the tool and the individual prongs to repair the divot holes. Both versions can press the divot material up against a flat surface of the tool to further flatten the playing surface.

20 Claims, 8 Drawing Sheets

(56) References Cited

U.S. PATENT DOCUMENTS

| | | | | |
|---|---|---|---|---|
| 5,511,785 | A * | 4/1996 | Rusin, Jr. | A01B 1/24 473/286 |
| 5,779,558 | A * | 7/1998 | Britton | A63B 60/16 473/286 |
| 5,782,443 | A * | 7/1998 | La Fontaine | A63B 55/10 248/156 |
| 6,048,274 | A * | 4/2000 | Lesage | A63B 57/50 473/286 |
| 6,244,356 | B1 * | 6/2001 | Luna | A01B 1/24 172/381 |
| 8,920,265 | B1 * | 12/2014 | Jones | A63B 57/50 473/408 |
| 2004/0048694 | A1 * | 3/2004 | Swensen | A63B 57/50 473/408 |
| 2006/0025230 | A1 * | 2/2006 | Zeuch | A63B 60/00 473/286 |
| 2007/0298900 | A1 * | 12/2007 | Johnson | A63B 57/353 473/286 |
| 2017/0151477 | A1 * | 6/2017 | Fallon | A63B 57/50 |

* cited by examiner

| |
|---|
| LOCKING GROOVES 426 |
| SLEEVE MATERIAL 430 |
| TAB MATERIAL 432 |

| |
|---|
| PRONG MATERIAL 308 |

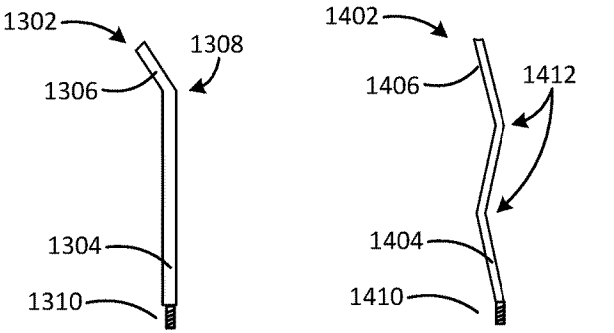
FIG. 13
FIG. 14
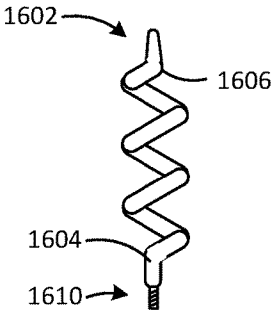
FIG. 15
FIG.16
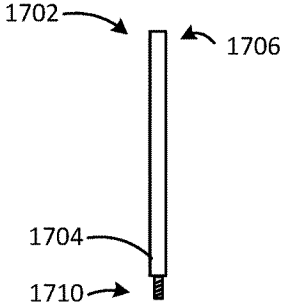
FIG. 17
FIG. 18
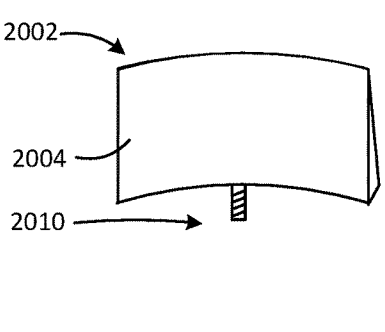
FIG. 19
FIG. 20
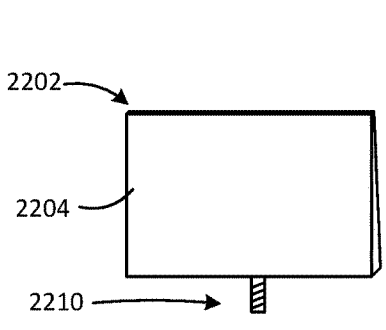
FIG. 21
FIG. 22
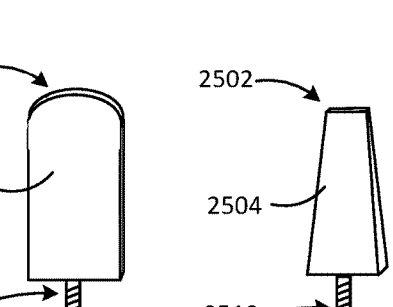
FIG. 23
FIG. 24
FIG. 25

DIVOT TOOL AND METHOD OF MANUFACTURE THEREOF

PRIORITY CLAIM

This application claims benefit of Provisional Application No. 62/989,184, filed Mar. 13, 2020, the entire contents of which is hereby incorporated by reference as if fully set forth herein, under 35 U.S.C. § 119(e). The applicant(s) hereby rescind any disclaimer of claim scope in the parent application(s) or the prosecution history thereof and advise the USPTO that the claims in this application may be broader than any claim in the parent application(s)

TECHNICAL FIELD

Embodiments relate generally to tools for playing golf, and, more specifically, to a divot repair tool for repairing divots and divot holes in grass surfaces.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Golf is a sport enjoyed by millions of people all over the world. The sport is played by hitting a golf ball with a club. When swinging the golf club, the process of striking the golf ball can often form a divot, or hole, in the grassy playing surface. When the ball lands, it can often form a divot on the green or other parts of the playing surface.

Some golfers carry a variety of secondary tools and appliances in addition to their golf clubs. These tools can include ball markers, cleat tools, towels, distance finders, ball retrieval devices, ball cleaners, etc. One of the more frequently used tools is a divot tool for repairing the grassy playing surface after a divot has been formed.

Divot tools often include a handheld two-pronged hand device which can be inserted into the grassy playing surface and used to restore the grass to a semblance of its original condition. Such devices are often pocket sized and carried by the golfer or included in the golf bag. This requires the golfer to bend over to use the tool to repair the surface.

BRIEF DESCRIPTION OF THE DRAWINGS

The present invention is illustrated by way of example, and not by way of limitation, in the figures of the accompanying drawings and in which like reference numerals refer to similar elements and in which:

FIG. 13 depicts an exemplary view of a single bend prong, FIG. 14 depicts an exemplary view of a multiple bend prong, FIG. 15 depicts an exemplary view of a three-dimensional multiple bend prong, FIG. 16 depicts an exemplary view of a spiral prong, FIG. 17 depicts an exemplary view of a straight prong, FIG. 18 depicts an exemplary view of a curved prong, FIG. 19 depicts an exemplary view of a curved blade, FIG. 20 depicts an exemplary view of a sharpened curved blade, FIG. 21 depicts an exemplary view of a flat blade, FIG. 22 depicts an exemplary view of a sharpened flat blade, FIG. 23 depicts an exemplary view of multiple blades, FIG. 24 depicts an exemplary view of a rounded blade, FIG. 25 depicts an exemplary view of an angled blade.

DETAILED DESCRIPTION

Figure 1:
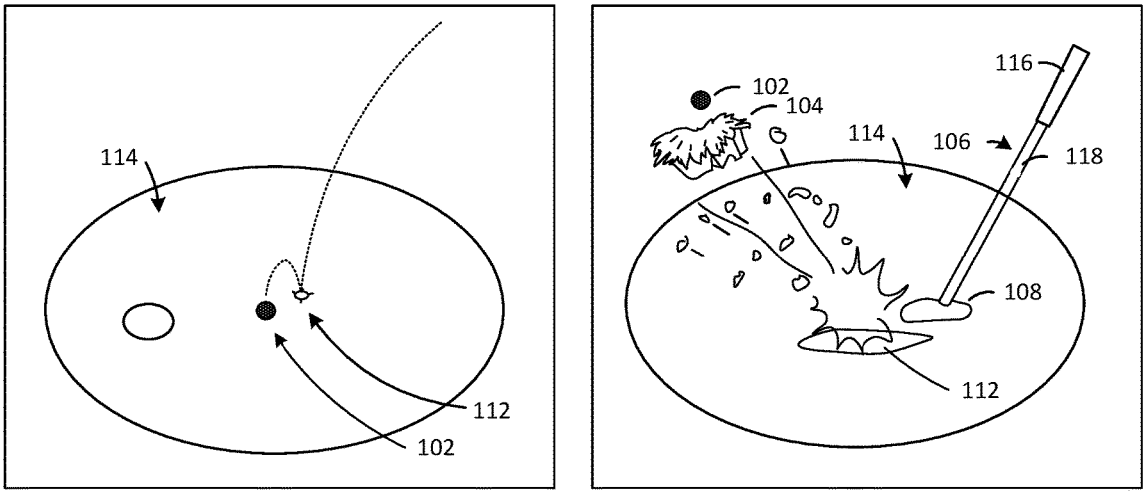
FIG. 1 depicts a view of a golf club hitting a golf ball to land on a player surface.

In the following detailed description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Embodiments are described herein according to the following outline:

| | |
|---|---|
| 1.0. | Overview |
| 2.0. | Structural Overview |
| 3.0. | Implementation Mechanism |
| | 3.1. Divot Repair Tool |
| | 3.2. Prongs |
| | 3.3. Blades |
| | 3.4. Automated Divot Repair Tool |
| 4.0. | Functional Overview |
| 5.0. | Example Embodiments |
| 6.0. | Extensions and Alternatives |

1.0. Overview

Approaches, techniques, and mechanisms are disclosed for manufacturing and use of the divot repair tool for repairing golf playing surfaces. The divot repair tool can be attached to a variety of shaft options to simplify the repair of the divots. In the various embodiments, the divot repair tool can provide an improved device and process for fixing divots.

The act of striking a golf ball often results in hitting the grassy playing surface of the golf course with the head of a golf club and creating a hole in the grassy surface. The resulting divot is a piece of grassy turf cut from the ground by action of striking the golf club on the playing surface. The divot may form one or more portions of grass, sod, and dirt. The act of the golf ball landing on the playing surface can also result in a dent or hole being formed in the playing surface. However, it is understood that the term divot can have different meanings due to the informal nature and widespread popularity of the game. The term divot can be used to describe the piece of grassy turf cut from the playing surface, the dent created by the landing of the golf ball, the divot hole created by the removal of the piece of grassy turf from the playing surface, or a combination thereof. The term divot hole can also be used to describe the dent formed by the golf ball landing on the playing surface, the hole resulting from the piece of the playing surface being removed, or a combination thereof. The terms divot and divot hole can be used interchangeably.

When a divot and divot hole are created, the general rules and guidelines of the game requires that the divot and the divot hole created be repaired to restore the playing surface to a near original condition. Divots are often repaired by fixing the divot and stamping down on the divot to help seat it firmly in the divot hole on the playing surface. However, this is not always an effective solution.

Further, some divots are indentions in the grassy surface of the playing surface, such as the putting green, when the golf ball landed and left an indentation. In this case, the player should try to decompress the indentation and restore the playing surface to its original flatness.

According to one embodiment, the divot repair tool can comprise a prong subsystem attached to an attachable base. The prong subsystem can have a variety of prong and levering mechanisms to improve the performance of the divot repair tool.

According to another embodiment, the divot repair tool can comprise a variety of individually actuated prongs with different directional configurations for improving the repair action of the tool. The divot repair tool can leave an improved playing surface by pulling more soil in at the base of the replaced divot.

According to another embodiment, the divot repair system can include a self-flattening mechanism for improving the surface of the repaired divot. The repair tool can include a manual or powered mechanism for compressing the divot against an upper flattening surface.

In other aspects, the invention encompasses divot repair tools configured to carry out the foregoing techniques.

2.0. Structural Overview

FIG. 1 illustrates a view of a golf club 106 hitting a golf ball 102 to land on a playing surface 114. The club head 108 of the golf club 106 is swung at the golf ball 102. It can strike a combination of the golf ball 102 and the playing surface 114, such as the turf, fairway, driving box, grass playing surface, or other similar playing surface 114. The strike can cause a divot 104 to become detached or separated from the playing surface 114 and leaving a divot hole 112 in the playing surface 114. strikes the playing surface 114. In addition, the golf ball 102 can land on another portion of the playing surface 114, such as the green, and form a dent or impression, which is another type of divot hole 112.

The golf ball 102 is a spherical playing element having certain elastic properties. When struck with the club head 108 of the golf club 106, the golf ball 102 can be moved down the playing surface 114.

The golf club 106 can have a variety of different characteristics and elements. The golf club 106 includes the club head 108, a club shaft 118, and a grip 116.

The club head 108 is a structural element having a flat face for hitting the golf ball 102. The club head 108 can have different weights, loft, and composition depending on the type of golf club 106.

The club shaft 118 is a structural element that is substantially straight, generally cylindrical, and of varying length. The golf club 106 can flex while being swung but is generally a rigid element that transmits the force of the swing from the grip 116 to the club head 108.

The grip 116 is the primary interface between the golf club 106 and the player. The grip 116 can have a variety of different properties depending on the type of the golf club 106. The grip 116 can be porous, solid, rubber, fabric, or other materials. The grip 116 is generally a tapered cylinder around the end of the club shaft 118 opposite of the club head 108.

In one embodiment, when the golf club 106 is swung at the golf ball 102, a divot 104 can be knocked out of a divot hole 112 by the club head 108. The divot 104 is a mass of grass and dirt cut from the playing surface 114 in making a stroke with the golf club 106. The divot hole 112 can generally be repaired by replacing the divot 104 in the divot hole 112 and pressing down to reseat the roots of the divot 104 in the soil of the divot hole 112. In other embodiments, the soil of the divot hole 112 can be loosened to help restore the divot 104. The soil can be loosened using a divot tool.

In another embodiment, the golf ball 102 can create a divot hole 112 by landing forcibly on the placing surface. Particularly on putting green surfaces, such an impact can form an indentation that needs to be repaired. In this case, the divot 104 may be a portion of the grass or turf that has been impacted and compressed and may lie below the top surface of the playing surface 114.

As described above, different types of the divot 104 and the divot hole 112 can exist. It is understood that many other types of the divot 104 and the divot hole 112 can be formed and all need to be repaired in a quick and expeditious manner to prevent disruptions in the flow of the game of golf.

Figure 2:
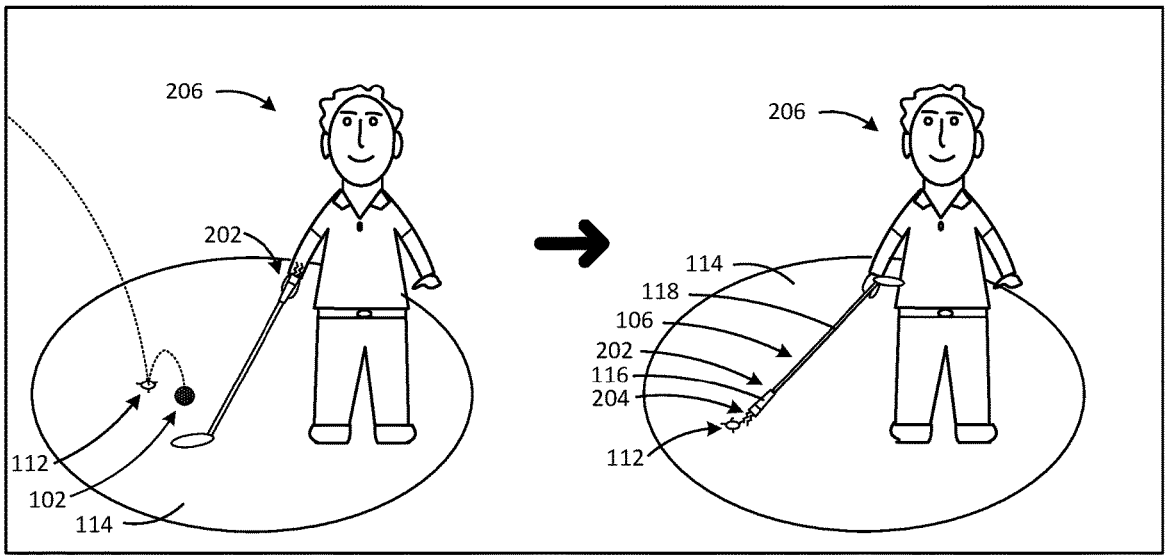
FIG. 2 depicts a use of a divot repair tool in an embodiment.

FIG. 2 illustrates a use of a divot repair tool 202 in an embodiment. The divot repair tool 202 can be used to repair the playing surface 114, such as the green. The golf ball 102 can land on the green with significant force and form a hole, dent, or ball mark in the playing surface. This can affect the play of subsequent players and should be repaired. The term divot hole can mean a dent, a ball mark, and a hole. The term divot can mean a bump, dent, or hole when the divot is on the green.

In the left portion of the figure, the golf ball 102 lands on the playing surface 114, such as on the green near the hole, and deforms the playing surface by forming the divot hole 112 which can also be described as a dent, a divot, a ball mark, or other similar terms. The player 206 can then repair the divot hole 112 using the divot repair tool 202 to fix the playing surface 114.

In the right portion of the figure, the player 206 can reverse the golf club 106 and use a divot repair tool 202 attached to the grip 116 to repair the divot hole 112. The divot repair tool 202 can be inserted into the playing surface 114 at the location of the divot hole 112 to fix the surface using a levering or a rotation motion.

The divot repair tool 202 can be attached to the grip 116. The divot repair tool 202 can include prongs 204 that can be used to penetrate the playing surface 114. The prongs 204 are rigid structural elements configured to penetrate the playing surface 114. The prongs 204 can be cylindrical, rectangular, flat, straight, bent, curved, spiral-shaped, or have other similar properties. The prongs 204 can be used to manipulate the soil and vegetation of the playing surface 114. The prongs 204 can be formed from different materials such as metal, alloys, plastic, wood, ceramic, or a combination thereof.

The player 206 can invert the golf club 106 and use the divot repair tool 202 to fix the divot hole 112. The divot repair tool 202 can be inserted into the ground adjacent to the divot hole 112 and used as a lever to pry up material, such as soil, from below the playing surface 114 to help smooth out the playing surface 114 damaged by the repair of the divot hole 112 made by the golf ball 102.

Alternatively, the player 206 can insert the divot repair tool 202 into the divot hole 112 and rotate the golf club 106 using the prongs 204 in a corkscrew-like motion to level the playing surface 114. The prongs 204 of the divot repair tool 202 can be oriented to lift the material of the playing surface 114 when rotated around an axis running down the center of the golf club 106.

Using the divot repair tool 202 attached to the grip 116 of the golf club 106 can improve the repair operation by making it easier to reach the area adjacent to the divot hole 112 with the divot repair tool 202. Further, the longer lever arm of the golf club 106 can make it easier to lever up the material to fix the divot hole 112.

Attaching the divot repair tool 202 to the golf club 106 can offer the advantage of making the divot repair tool 202 easy to use and readily available when playing golf. In different embodiments, the divot repair tool 202 can be attached to the golf club 106 in different ways. For example, the divot repair tool 202 can be attached directly to the grip 116, attached directly to the shaft 118 of the golf club 106, or a combination thereof. In some embodiments, the divot repair tool 202 can include a portion that can replace the grip 116 when the divot repair tool 202 is attached directly to the shaft 118 of the golf club 106. The divot repair tool 202 can be optionally covered with a cap for safety.

In some embodiments, the player can use the divot repair tool 202 attached to the golf club 106 to repair the divot hole 112 with a minimum of bodily bending. This can enable mobility limited players to repair holes without having to bend over. The divot repair tool 202 can be operating from a standing position making it easier to use by players having mobility and flexibility limitations.

Figure 3:
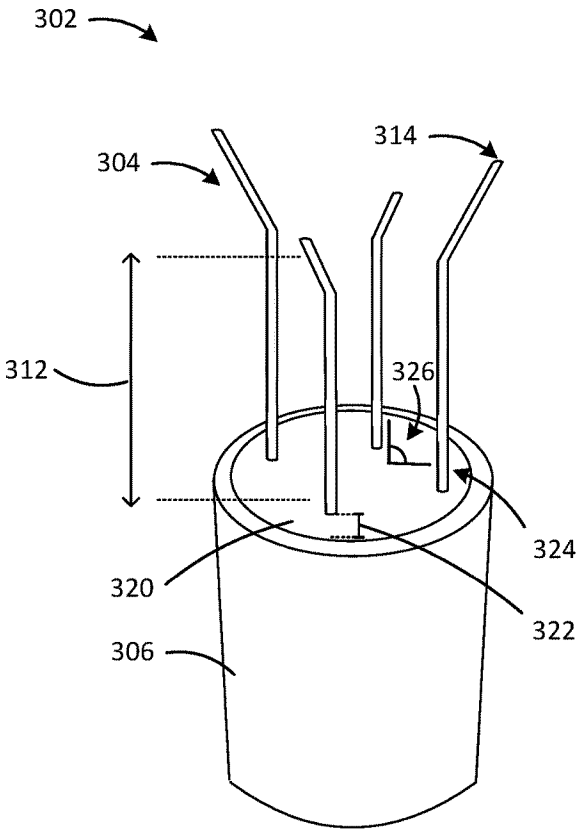
FIG. 3 depicts a view of a divot repair tool in an embodiment.

FIG. 3 illustrates a view of a divot repair tool 302 in an embodiment. The divot repair tool 302 can include one or more prongs 304 securely attached to a tool base 306. The divot repair tool 302 can be used to replace and repair a divot 104 on a playing surface 114.

The tool base 306, such as a hub or base unit, is a structural element for attaching the prongs 304. The tool base 306 can be formed from a rigid material such as a metal, an alloy, a plastic, a composite material, a ceramic material, wood, stone, or a combination thereof. The tool base 306 can be in the shape of a disk with a central opening and mounting point for the prongs 304.

The prongs 304 are rigid elements extending from the tool base 306. Each of the prongs 304 can have a prong length 312 that can be measured in a variety of ways. In one example, the prong length 312 can be a vertical measurement from a tool base top surface 320 of the tool base 306 to a prong tip 314. In another example, the prong length 312 can be measured along the entire length of one of the prongs 304 including any portion of the prongs 304 inside the tool base 306.

The prongs 304 and the prong length 312 can be configured in a variety of ways. The length of the prongs 304 can influence the effectiveness and efficiency of divot repair operation. In one embodiment, each of the prongs 304 can have the prong length 312 having equal length value. In another embodiment, the prongs 304 can each have the prong length 312 having different length values. In yet another embodiment, some of the prongs 304 can have the same length, while others can have a different length. For example, separate pairs of the prongs 304 can have the same length, while other pairs have a different length. In an illustrative example, the prongs 304 can include a set of long prongs having a length of 1⅛ inches long and a set of short prongs having a length of ⅝ inches long.

In an illustrative example, the prongs 304 can have two long prongs where the prong length 312 of the long prongs can be between two to four inches extending from the tool base 306 to the prong tip 314. The prongs 304 can also include two short prongs approximately half the length of the long prongs. The prong length 312 of the short prongs can be between one and two inches extending from the tool base 306 to the prong tip 314. The prong length 312 generally does not include the length of the prong below the surface of the tool base 306. The prong length 312 can be expressed as the length of the prong including any additional length due to geometry such as bends, ridges, spirals, or other mechanism shape factors. The prong length 312 can also be expressed as the length of the prong not including any shape or geometry features. The prong length 312 can be varied depending on factors including type of sod or grass, hardness of playing surface, depth of soil, or other similar factors. In another illustrative example, the prong 304 can have pairs of the prongs with the prong length 312 configured between one-half and one inch and another pair of the prongs with the prong length 312 configured between one and two inches. The selection and length of the prongs 304 can be varied to compensate for the condition of the playing surface 114. For example, if the playing surface 114 is soft, then longer prongs may be used. If the playing surface 114 is hard, then shorter prongs may be more effective.

The divot repair tool 302 can have different arrangements of the prongs 304 and they can be positioned on the tool base 306 in a variety of configurations. In some embodiments, the divot repair tool 302 can have a different number of the prongs 304. For example, the divot repair tool 302 can have any number of the prongs 304. The divot repair tool 302 can have two prongs, three prongs, four prongs, five prongs, six prongs, or other numbers of the prongs 304.

The prongs 304 can be arranged on the tool base 306 in a variety of positions. In one embodiment, the prongs 304 can be arranged along the perimeter of the tool base 306. The prongs 304 can be offset by a prong offset distance 322 from the outer perimeter of the tool base 306. The prongs 304 can be arranged in rows, in a circular pattern, in a grid pattern, in a geometrical pattern, along a circular path following a perimeter, in a triangular pattern, in a rectangular pattern, evenly space, unevenly space, or in a combination thereof.

In another embodiment, the prongs 304 can be positioned in different geometrical shape arrangements including a circle, a square, a pentagon, star, X, or other similar geometrical shape. The prongs 304 can be positioned symmetrically including linear symmetry, radial symmetry, circular symmetry, or other similar geometrical symmetries.

In yet another embodiment, the prongs 304 can be positioned substantially vertically. This can include having a prong base portion 324 aligned perpendicular to the top surface of the tool base 306 and having a prong angle 326 of ninety degrees. The prong base portion 324 is the portion of the prongs 304 directly attached to the tool base 306.

It is understood that mechanical mounting processes and general wear and tear can change the actual value of the prong angle 326 from ninety degrees to substantially similar to ninety degrees. The actual value of the prong angle 326 can be considered perpendicular to tool base 306 when the prong angle 326 varies from true perpendicular with a deviation range of zero to five degrees from of a measured ninety degrees. In another embodiment, the deviation range can be between zero and fifteen degrees from vertical.

In another embodiment, the prongs 304 can be arranged with a different value of the prong angle 326. It is understood that arranging the prongs 304 not perpendicular to the tool base and can include having the prong angle 326 at other angles. For example, the prongs 304 have the value of the prong angle 326 between ninety degrees and forty-five degrees to improve the ability of the prongs 304 to interface with the playing surface 114.

In yet another embodiment, the prongs 304 can be arranged differently based on the prong length 312 and the prong angle 326. For example, the prongs 304 can be arranged as two long prongs and two short prongs to increase the effectiveness of the lever action of the tool. In another example, the prongs 304 can have all the same value of the prong length 312. In another example, the prongs can be arranged to have an increasing value of the prong length 312 along the perimeter of the tool.

The prongs 304 can be configured with different shapes. In different embodiments, one or more of the prongs 304 can have a straight body and a single angular tip portion, a multi-bend structure, a multi-bend structure forming a three-dimensional structure, a straight structure, a curved structure, a corkscrew structure, a flat plate, a curved plate, a blade, a multiple blade structure, a rounded structure, a pyramid structure, and structures with other shapes. The blades can be formed from different materials such as metal, alloys, plastic, wood, ceramic, or a combination thereof.

In an illustrative example, the prongs 304 can have a straight body with a single angular bend at the prong tip 314. The prong tip 314 of each of the prongs 304 can be aligned in different ways. The prong tips 314 can be arrange pointing outward, pointing inward, or pointing along the circular path around the perimeter of the divot repair tool 302. The prong tips 314 can be aligned in pairs with each pair of the prong tips 314 pointing in different directions including toward one another, away from one another, or at an angle between thirty degrees and ninety-degrees from one another in a clockwise or counter-clockwise configuration to support rotation. The prong tips 314 of the prongs can have a vertical deflection angle between five and sixty degrees to enable and improve the ability of the prongs to engage the playing surface. The prong tips 314 can be configured to improve penetration performance including using pointed tips, edged tips, ridges, serrations, bladed tips, chisel-tips, carbide tip, or other similar techniques.

The prongs 304 can be attached to the tool base 306 in a variety of ways. For example, each of the prongs 304 may be attached to the tool base 306 by welding, a pressure bond, mounted in a hole, with an adhesive, screwed into a hole, or other similar techniques.

The prongs 304 can be formed from a variety of materials. The prongs 304 can be formed from a prong material 308 such as a metal, an alloy, ceramic, plastic, resin, glass, composite materials, or a combination thereof. The prong material 308 can be treated to improve performance including hardening, case hardening, grain hardening, solid solution strengthening, precipitation hardening, martensitic transformation hardening, nitriding, cyaniding, carbonitriding, plating, bonding, or other similar hardening techniques. The prongs 304 can be configured to improve penetration performance including having the prong tips 314 that have pointed tips, edged tips, ridged tips, serrations, bladed tips, chisel-tips, carbide tips, or other similar techniques.

Figure 4:
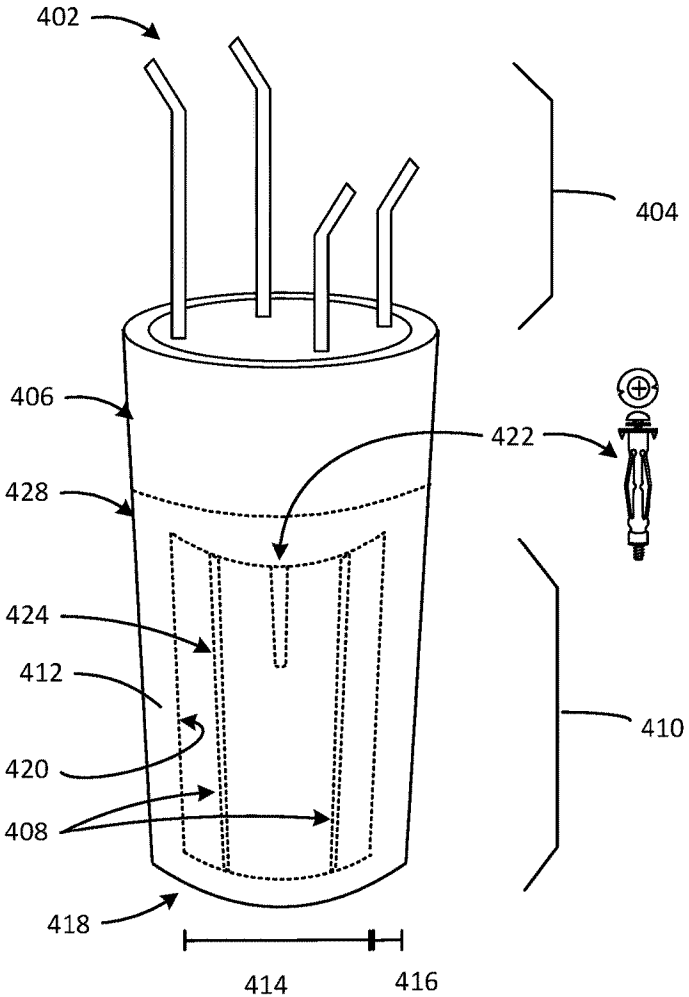
FIG. 4 depicts a view of a divot repair tool in an embodiment.

FIG. 4 illustrates an isometric view of a divot repair tool 402 with a mounting adapter 410. The divot repair tool 402 can be attached to the golf club 106 using the mounting adapter 410. The divot repair tool 402 can include prongs 404 for manipulating and repairing the playing surface 114. In some embodiments, the mounting adapter 410 can include the grip 116.

The divot repair tool 402 can include the mounting adapter 410 for coupling the divot repair tool 402 to the golf club 106. The mounting adapter 410 is a structural element for connecting the bottom side of the divot repair tool 402 securely to an extension element 106 such as the golf club 106, a pole unit, a telescoping rod, stick, staff, pole, multiple segment pole, or another similar extension element. The extension element 106 can help extend the reach of the divot repair tool 402 and allow the divot repair tool 402 to be used at a distance without bending over. Although the term golf club is used, it is understood that the golf club 106 can be interchanged by the other terms for the extension element 106. In addition, the extension element 106 can be referred to as the pole unit.

The mounting adapter 410 is directly attached to the tool base 406 in a variety of ways. The mounting adapter 410 can be attached with screws, posts, pins, adhesive, welding, rivets, clamps, or other similar mechanisms. In one embodiment, the covering of the mounting adapter 410 can be extended to cover a portion of the tool base 406.

The mounting adapter 410 can be attached to the golf club 106 in a variety of ways. For example, the mounting adapter 410 can attach the divot repair tool 402 to the grip 116 of the golf club 106 with a screw mechanism, a pin and groove mechanism, a latch, an adhesive, a mechanical coupling, or other technique for attaching and connecting two structural elements. In another example, the mounting adapter 410 can be attached to the bottom of the divot repair tool 402, cover and attach to the sides of the divot repair tool 402, or be otherwise fastened to the divot repair tool 402. In another example, the mounting adapter 410 can be integrated with the grip 116 and the grip portion can be attached directly to the shaft 118 of the golf club 106. The mounting adapter 410 can then replace the grip 116 with the mounting adapter 410 integrated with the grip 116.

In another embodiment, the mounting adapter 410 can include an attachment mechanism 428, such as a flexible sleeve 412 that can be mounted over the back of the grip 116 to attach the divot repair tool 402. The attachment mechanism 428 is an element for coupling the mounting adapter 410 to the golf club 106.

The flexible sleeve 412 can be sized to fit snuggly over the back of the grip 116. The flexible sleeve 412 can a cylindrical structure with an opening on the inside where the grip 116 can be inserted.

The flexible sleeve 412 can be made from a variety of materials. For example, the flexible sleeve 412 can be formed using a sleeve material 430 of rubber, polymers, fabric, metal, alloy, plastic, a composite material, or other similar materials. In one embodiment, the flexible sleeve 412 can be a flexible material that can be stretched or have compressive properties.

In one embodiment, the flexible sleeve 412 can include a sleeve opening 418. The sleeve opening 418 is the opening to the inside of the flexible sleeve 412. The sleeve opening 418 is located on the side of the divot repair tool 402 opposite from the prongs 404. The sleeve opening 418 can be made from a flexible material and can be stretched over the grip 116 to attach the divot repair tool 402 to the golf club 106.

The sleeve opening 418 can have a sleeve opening width 414. The sleeve opening width 414 is the inner diameter of the sleeve opening 418 measured at the bottom of the flexible sleeve 412. The sleeve opening width 414 can be smaller than the width of the grip 116 to ensure a good tight fit on the golf club 106.

The flexible sleeve 412 can have a sleeve wall thickness 416 measured at the bottom of the sleeve opening 418. The sleeve wall thickness 416 of the flexible sleeve 412 can be a factor in determining the ability of the flexible sleeve 412 to hold firmly to the grip 116. The sleeve wall thickness 416 can be sized to a value thick enough to hold the divot repair tool 402 to the grip 116.

For example, for some materials, such as rubber, types of plastic, or composite materials, the sleeve wall thickness 416 can be the equivalent thickness as the grip 116. In another example, the sleeve wall thickness 416 can vary between 0.05 inches and 0.5 inches.

The mounting adapter 410 can include an interior surface 420, such as the inner surface of the flexible sleeve 412. When attached to the golf club 106, the interior surface 420 can for an interference fit with the grip 116 to hold the mounting adapter 410 in place. The interference fit can include a press fit, a friction fit, or other types of mechanical fastening between two elements. In another embodiment, the interior surface 420 can also have an adhesive layer (not shown) to help the attachment to the grip 116. The mounting adapter 410 can be attached to the grip 116 with a combination of the interference fit and the adhesive attachment from the adhesive layer.

In yet another embodiment, the mounting adapter 410 can include a mounting pin 422. The mounting pin 422 is a protruding element from the mounting adapter 410 that can be coupled to the grip 116 of the golf club 106. The mounting pin 422 can help attach the mounting adapter 410 to the golf club 106. The mounting pin 422 can be positioned within the interior of the mounting adapter 410 and can be configured to be inserted into a hole in the grip 116 of the golf club 106.

The mounting pin 422 can have a variety of configurations. For example, the mounting pin 422 can be an anchor screw, an anchor bolt, a wedge anchor, a sleeve anchor, an expansion anchor, a flat head anchor, a toggle anchor, a cam anchor, a moly bolt, or other fastener attached to the shaft of the golf club 106. In a further example, the mounting pin 422 can be an expandable anchor screw with a built-in screw that can be tightened to expand the sides of anchor screw to tightly grip the inner wall of the golf club. The mounting pin 422 can be attached to the tool base 406.

In another embodiment, the grip 116 can be configured with a grip opening that can receive the mounting pin 422 having a screw tip and allow the mounting adapter 410 to be screwed into the grip 116. The grip opening can be paired with a backing mechanism to secure the mounting pin 422 in place. In some configurations, the grip opening can include two or more openings to help prevent rotation of the grip.

In still another embodiment, the grip 116 can be configured with a threaded adapter (not shown) at the end of the grip 116 and the mounting adapter 410 can be screwed onto the threaded adapter of the grip 116.

To prevent rotation of the divot repair tool 402 around the golf club 106 during use the mounting adapter 410 and the extension element or grip 116, the mounting adapter 410 can include a rotation prevention mechanism 408. The rotation prevention mechanism is a device or structure for preventing, inhibiting, or limiting the rotation around a shaft under the application of a torsional force. For example, the rotation prevention mechanism should be able resist a rotational torque of more than twenty Newton meters. Other configuration of the rotation prevention mechanism should resist the torque produced by the human hand. This value can range above fifty Newton meters.

The rotation prevention mechanism, also known as an anti-rotation mechanism or rotation lock, can have a variety of forms. This can include a pin lock, a tongue and groove element, a friction lock, screw, lock bar, an interlock device, or other similar mechanisms. The rotation prevention mechanism can also be implemented using an anchor screw that attaches firmly to the inside of the golf club shaft using pressure from the expanding body of the anchor screw.

In this case, the rotation prevention mechanism is a device for preventing or limiting relative rotation between the mounting adapter 410 and grip 116. The grip 116 is attached to the golf club 106 and the mounting adapter 410 is attached to the grip 116.

More specifically, the rotation prevention mechanism can allow the mounting adapter 410 to be attached to the grip 116 of the golf club 106 and prevent the mounting adapter 410 from rotation when used in a rotational manner, such as twisting, turning, or otherwise rotating. The rotation prevention mechanism can lock the divot repair tool 402 in place when the golf club 106 and prevent, inhibit, or reduce the loss of rotational energy due to rotational slipping. Rotational slipping is the relative rotational motion between the divot repair tool 402 and the golf club 106.

In one embodiment, the divot repair tool 402 can be configured with locking tabs 424 on the interior surface 420 of the flexible sleeve 412. The locking tabs 424 are raised protrusions on the interior surface 420. The locking tabs 424 can be elongated structures having widths less than the length. The locking tabs 424 can include ridges, seams, bars, rails, tongues, or other similar elements.

The locking tabs 424 can have varying structural properties including shape, length, width, height, and composition. The locking tabs 424 can be linear structures having one or more segments. The locking tabs 424 can have equal width over their length, have a decreasing width over their length, or have varying width over their length. For example, the locking tabs 424 can have shapes including rectangular solids, rhomboids, pyramidal shapes, rounded cylinders, or other similar shapes and three-dimensional forms. In some embodiments, the width of the locking tabs 424 can taper toward the end of the sleeve opening 418.

The locking tabs 424 can be formed from a variety of materials. The locking tabs 424 can be formed from a tab material 432 such as resin, plastics, polymers, rubber, composites, metal, alloy, ceramic, or other similar materials. In an example, the locking tabs 424 can be formed the same material as the flexible sleeve 412. The locking tabs 424 can be formed by molding, three-dimensional printing, cutting, laser ablation, or other manufacturing processes.

The rotation prevention mechanism can be implemented in a variety of ways. For example, the rotation prevention mechanism can include a mechanical interlock system such as locking tabs and grooves, a friction lock, a geared lock mechanism, a screw lock, a clamp, or similar mechanism. The rotation prevention mechanism can be configured to inhibit the rotational motion beyond that effect provided by the unimproved attachment to the grip 116 and the shaft 118. The rotation prevention mechanism must be more than the simple contact friction from a conventional attachment of the grip 116 to the shaft 118.

The locking tabs 424 can be configured to align and interlock with locking grooves 426 of the grip 116. The locking grooves 426 are on the grip 116. The locking grooves 426 can be formed in the grip 116 in advance or can be formed by the installation of the divot repair tool 402. For example, if the material of the grip 116 is deformable, then installing the mounting adapter 410 over the grip 116 can create indentations in the grip 116 in a dynamic or temporary fashion. The pressure of the locking tabs 424 on the grip 116 can form the locking grooves 426.

When the mounting adapter 410 is installed over the grip 116, the locking tabs 424 can be inserted into the locking grooves 426 to form the interlocking mechanism to prevent the rotation of the mounting adapter 410 around the grip 116. The sides of the locking tabs 424 can press against the interior sides of the locking grooves 426 to resist lateral or rotational motion between the two elements.

In another embodiment, the divot repair tool 402 can be configured with the rotation prevention mechanism such as a friction lock mechanism. The friction lock mechanism can secure the mounting adapter 410 in place relative to the grip 116 based on the friction between the two elements. The amount of friction between the two contacting surfaces can be increased by using a clamping mechanism. The clamping mechanism can be used to hold the two coupled elements together with pressure from an element such as a clamp, a tie, a lock, a bracket, vice, belt, knotted cord, twist tie, cinching mechanism, tape, hook and loop tape structure, or similar element.

In yet another embodiment, the divot repair tool 402 can be configured with the rotation prevention mechanism such as a gear lock mechanism. The gear lock mechanism can include interlocking teeth on both the mounting adapter 410 and the golf club 106. For example, the gear lock mechanism can include vertically or horizontally oriented gears and teeth. This can include tightening mechanisms, or other similar mechanisms.

In still another embodiment, the rotation prevention mechanism can be a screw lock. The screw lock is a threaded mechanism that can be engaged to prevent rotation between the inner and outer elements of the mechanism. For example, the screw lock can be a threaded screw penetrating the outer and inner elements, such as the mounting adapter 410 and the shaft 118 of the golf club 106.

Figure 5:
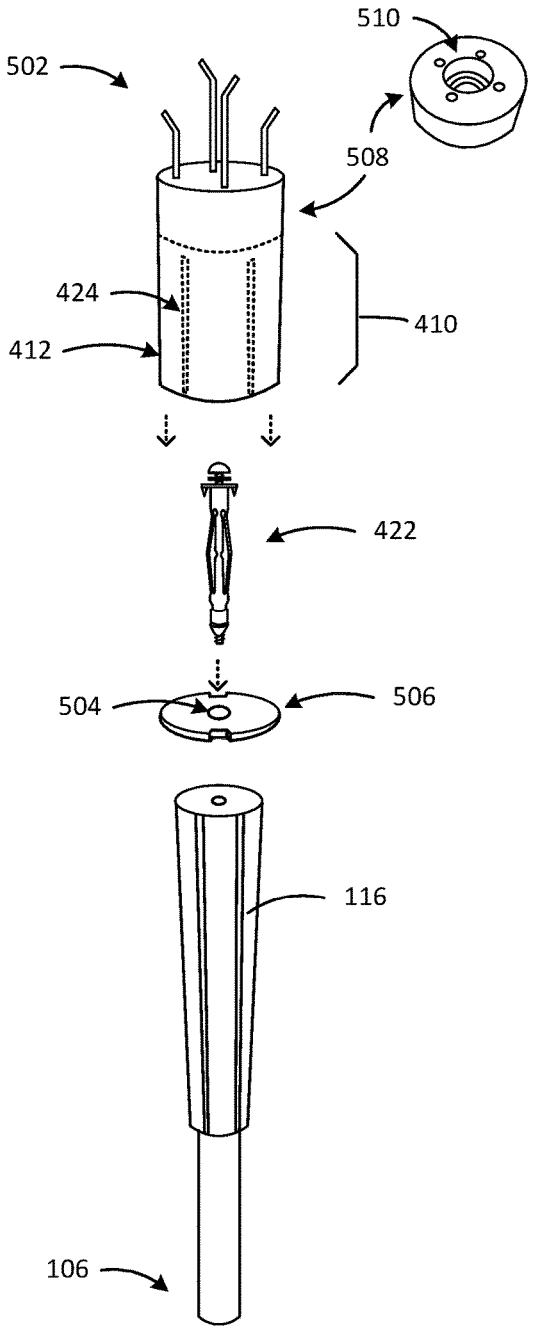
FIG. 5 depicts an isometric view of the divot repair tool with a mounting adapter.

FIG. 5 illustrates a side view of the divot repair tool 502 in another embodiment. The divot repair tool 502 can be attached to the grip 116 of the golf club 106 by positioning the mounting adapter 410 over the grip 116.

The divot repair tool 502 can have prongs 404 attached to a tool base 508. The tool base 508 is a mechanical component for mounting prongs 404 and coupling to the mounting adapter 410. In an example, the tool base 508 can be a hard component having mounting holes for the prongs 404. The tool base 508 can be formed from metal, alloy, plastic, composite, ceramic, etc. Typical examples of materials can include aluminum, steel, thermoplastics, or a combination thereof. The tool base 508 can have a central opening 510 that can be used to couple to a mounting pin 422, such as an anchor bolt. The central opening 510 can be sized to engage firmly with the top of mounting pin 422. In an illustrative example, the mounting pin 422, such as an anchor bolt, can be attached to the tool base 508 by inserting the mounting pin 422 through the central opening. In some configurations a washer or other mounting fixture can be used to attach the mounting pin 422 to the tool base 508.

The mounting adapter 410 can be attached to the golf club 106 by positioning the flexible sleeve 412 over the top of the grip 116. Optionally, the mounting pin 422 can be inserted in a grip hole 504 in the grip 116. Further, the mounting adapter 410 can include the locking tabs 424 to help resist rotation of the divot repair tool 502.

In an embodiment, the grip 116 can include a mounting disk 506. The mounting disk 506 is a structural element that can be affixed to the grip 116 or the golf club 106. The mounting disk 506 can provide a place to attach the divot repair tool 502.

The mounting disk 506 can have a variety of configurations. For example, the mounting disk 506 can have a rounded outer rim, a geared outer rim, a flanged rim, or other rim structures. The structures can allow the mounting adapter 410 to attach to the mounting disk 506. The mounting disk 506 can include a mounting hole 505 and notches 507. In some embodiments, the mounting disk 506 can have two notches 507 on opposite sides of the outer rim of the mounting disk 506. In some embodiments, the mounting pin 422 can be inserted through the mounting hole 505 and into the grip hole 504 of the grip 116.

The mounting disk 506 can be attached to the golf club 106 in a variety of ways. For example, the mounting disk 506 can be fastened to the shaft 118 of the golf club 106 by fasteners, welding, soldering, epoxy adhesives, a mechanical interlock, or other similar techniques. The mounting disk 506 can have an attachment to the shaft 118 that is strong enough to act as the rotation prevention mechanism 408. The mounting disk 506 can include indentations or notches to facilitate attaching the mounting adapter 410.

In one embodiment, the mounting disk 506 can be attached to the golf club 106 and act as a receptacle for the mounting adapter 410. The mounting disk 506 can be smaller, larger, or the same size as the back of the grip 116. This can allow the mounting disk 506 to be permanently attached to the golf club 106 to provide a stable mechanism for attaching the divot repair tool 402. The mounting adapter 410 can engage with the mounting disk 506 with gears, teeth, clamps, fasteners, or other similar techniques. Using the mounting disk 506 can provide a more secure attachment mechanism that using the grip 116 because the grip 116 can be formed using softer materials.

In another embodiment, the divot repair tool 502 can be attached to a putter grip or other golf club grip. The mounting pin 422, such as an anchor screw, can be inserted through the end of the grip and tightened with the built-in screw to engage with the inner side of the shaft 118. In some embodiments, the mounting pin 422 can have a flat top or cap area with two teeth or tabs bent downward at right angles to the flat top. The two teeth, such as triangular shaped teeth, can dig into the rubber of the grip to help reduce rotation. Alternatively, the two teeth can engage with apertures on the mounting disk 506 or another rigid portion of the club or grip. The mounting pin 422, such as an anchor screw, can have wings or bendable elements that can grip the inner sides of the shaft when the screw is tightened. This can help prevent rotation of the divot repair tool 502 during use.

Figure 6:
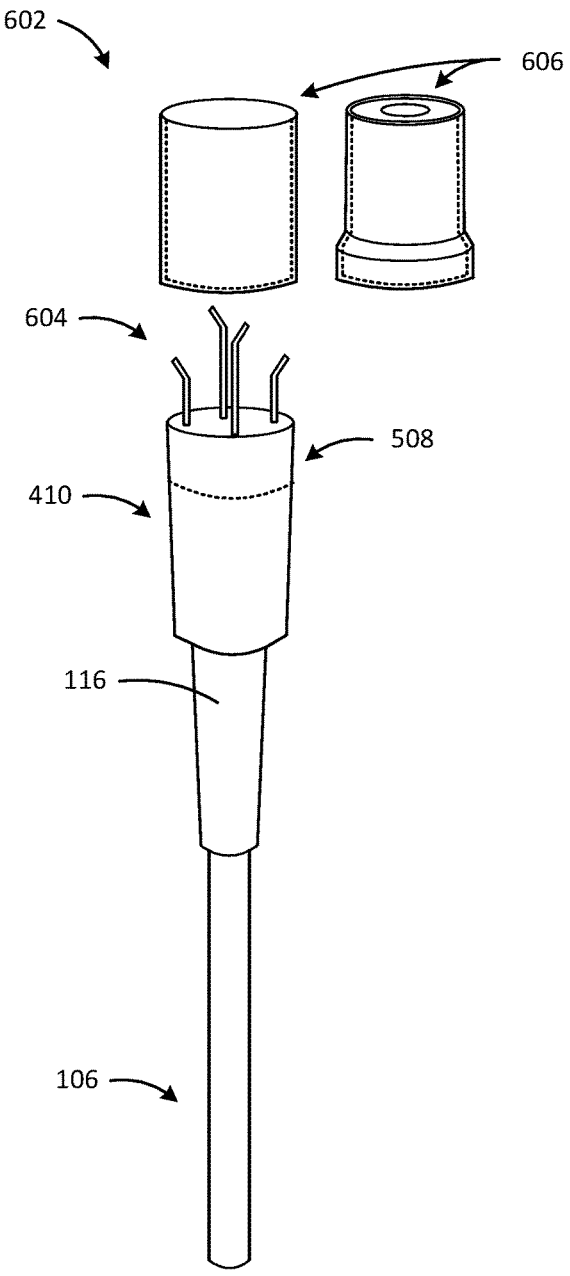
FIG. 6 depicts a side view of the divot repair tool attached to the golf club in another embodiment.

FIG. 6 illustrates a side view of the divot repair tool 602 attached to the golf club 106 in another embodiment. The mounting adapter 410 can be attached to the grip 116 of the golf club 106.

The divot repair tool 602 can be configured with a tool cap 606. The tool cap 606 is a protective cover to prevent damage associated with prongs 604 of the divot repair tool 602.

The tool cap 606 can have different configurations. In one configuration, the tool cap 606 can have the shape of a hollow cylinder. One end of the tool cap 606 can be attached to the tool base 508. In another embodiment, the tool cap 606 can have a wider base and then taper down to a smaller cylinder at one end. The tool cap 606 can be configured with a twist lock to securely attach to the grip. The tool cap 606 can be configured with indents on the top portion for attaching a magnet, a ball marker, or other implements. In a typical example, the cap can have dimensions of being 1⅝ inches long and 1 inch wide. The tool base 508 can be ¾ of an inch wide and 5/16 of an inch tall. The shaft of the golf club can have a diameter ranging between 0.5 inches and 0.6 inches. The shaft diameter can be measured at the butt of the shaft beneath the grip. The tool cap 606 can be attached to the divot repair tool 602 in a variety of ways. For example, the tool cap 606 can be screwed on, pressed on, clipped on, or attached in other similar ways.

The tool cap 606 can be formed from a variety of materials. For example, the tool cap 606 can be formed from metal, plastic, resin, wood, polymers, or other similar materials. The tool cap 606 can be a rigid object configured to protect the prongs 604 from damage and to prevent the prongs 604 from damaging other objects.

The tool cap 606 can be manufactured in a variety of ways. For example, the tool cap 606 can be three-dimensionally printed, extruded, molded, vacuum formed, cast, or formed by a similar manufacturing process.

3.0. Implementation Mechanism

3.1. Divot Repair Tool

Figure 7:
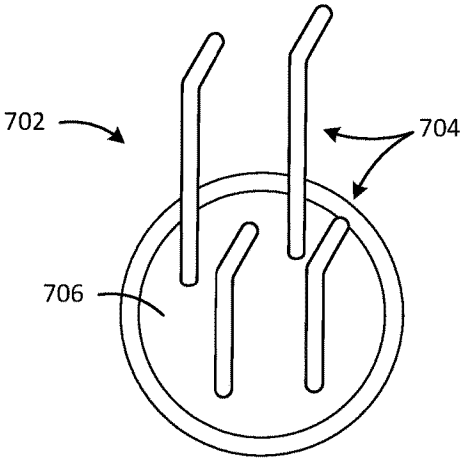
FIG. 7 depicts a paired length prong embodiment of a divot repair tool.

FIG. 7 illustrates a paired length prong embodiment of a divot repair tool 702. The divot repair tool 702 can include prongs 704 having paired length elements attached to a tool base 706.

The divot repair tool 702 can have two pair of the prongs 704 with each pair having a particular length. For example, in a configuration with four of the prongs 704, one pair of the prongs 704 can have a longer length than the other pair of the prongs 704.

The paired length prong configuration can penetrate the playing surface to improve the ability to lever up soil to repair the divot hole 112. Using the prongs 704 having different sizes can lever up more material from the divot hole 112 and better repair the playing surface 114.

Figure 8:
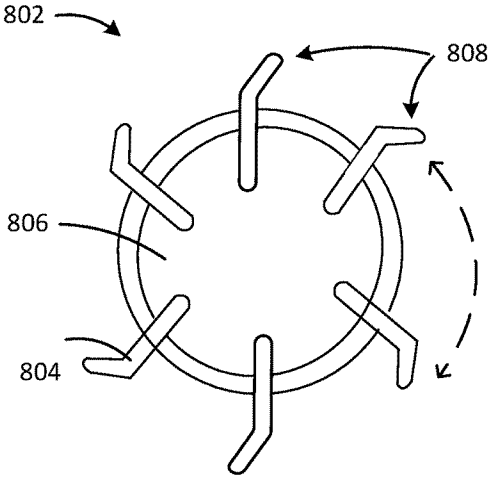
FIG. 8 depicts a rotational prong configuration a divot repair tool.

FIG. 8 illustrates a rotational prong configuration a divot repair tool 802. The divot repair tool 802 can include prongs 804 arranged to have ends of prongs 804 pointing in one direction around the circumference of the divot repair tool 802. In this case, the prongs 804 can be configured with a single angular prong tip.

The divot repair tool 802 can be configured with different numbers of the prongs 804. Although FIG. 8 is shown with six of the prongs 804, it is understood that different configurations are possible. In different embodiments, the divot repair tool 802 can have between three and ten of the prongs 804. In some embodiments, the divot repair tool 802 can have ten or more of the prongs 804.

The prongs 804 can be configured with different lengths. Although the prongs 804 are shown with the same apparent length, it is understood that the lengths can be different to improve the soil moving properties of the divot repair tool 802.

The prongs 804 are arranged pointing in a circular manner to allow the divot repair tool 802 to be operated by rotating the golf club 106 to impart a rotational motion on the divot repair tool 802 and bring up material from below the playing surface 114. By rotating the divot repair tool 802, the prongs 804 can be rotated with the prong tips 808 and twist into the soil. This rotational motion will cause the soil of the divot hole 112 to rise and repair the playing surface 114.

The rotational prong configuration can repair the playing surface 114 without levering the divot repair tool 802 to lever up material from below the playing surface 114. Being able to repair the divot hole 112 with or without the divot 104 without needed to bend over can improve the flow of golfing and reduce strain on the player's back. The rotational technique for repairing the divot hole 112 can help reduce repetitive strain injuries by invoking the use of different muscles than used in normal golf.

The rotational motion of the prongs 804 can lift the playing surface 114 and press it against flat surface of the tool base 806. This motion can provide a leveling or flattening effect and improve the repair of the playing surface 114 by tending to make the playing surface 114 flatter. This can improve the overall appearance and performance of the playing surface 114 and increase the quality of further golf play.

Figure 9:
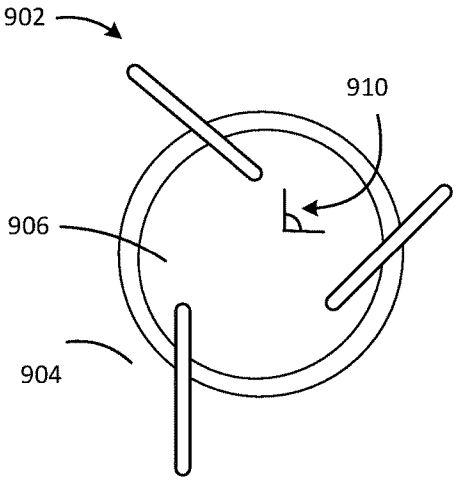
FIG. 9 depicts an angled prong configuration a divot repair tool.

FIG. 9 illustrates an angled prong configuration a divot repair tool 902. The divot repair tool 902 can include prongs 904 having a straight configuration and attached to a tool base 906 at a prong angle 910.

The prongs 904 can be attached the tool base 906 at an angle to arrange the prongs 904 to support a rotational action or a vertical levering action in operation. For example, the prongs 904 can be configured at a 45-degree angle from the surface of horizontal surface of the tool base 906 and having an overall counter-clockwise orientation to perform the repair operation when the divot repair tool 902 is rotated. The prongs 904 can be straight prong elements oriented vertically and horizontally to lift and repair the playing surface when rotated.

Although FIG. 9 shows three of the prongs 904, it is understood that the divot repair tool 902 can have any number of the prongs 904. In addition, although only a single circumferential row of the prongs 904 is shown, it is further understood that the divot repair tool 902 can have one or more rows of the prongs 904 to increase the ability of the divot repair tool 902 to interact with the playing surface 114. In different embodiments, the divot repair tool 902 can have between three and ten of the prongs 904 arrange in one or more circular rows. In some embodiments, the divot repair tool 902 can have ten or more of the prongs 904. In other embodiments, the prongs 904 can be arranged in other positional configurations as described in other sections of the specification.

Figure 10:
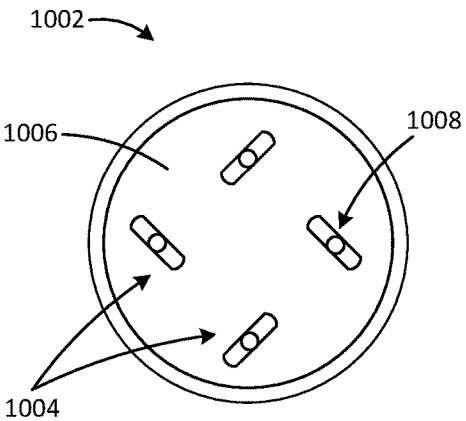
FIG. 10 depicts a multiple bend prong configuration a divot repair tool.

FIG. 10 illustrates a multiple bend prong configuration a divot repair tool 1002. The divot repair tool 1002 can include prongs 1004 having a multiple bend configuration. The prongs 1004 can be attached to the tool base 1006. The prongs 1004 with the multiple bend configuration can be more effective at engaging and moving the soil of the divot hole 112. Using a levering action with the prongs 1004 having a multiple bend configuration can lift up more soil and more effectively flatten the playing surface 114.

In another embodiment, the prongs 1004 can be configured in the multiple bend configuration with the bends oriented to allow a rotation action. Thus, rotating the tool base 1006 and the prongs 1004 can move the soil to flatten the playing surface 114.

Figure 11:
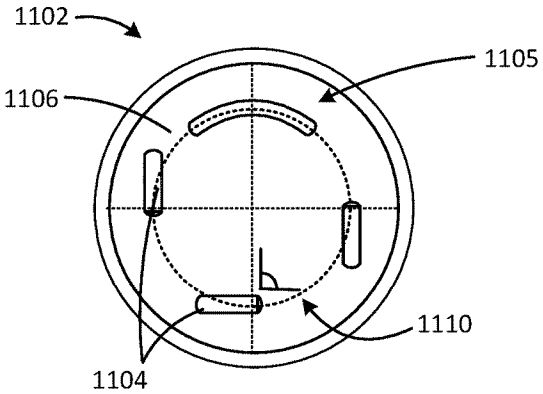
FIG. 11 depicts a curved blade configuration of a divot repair tool.

FIG. 11 illustrates a curved blade configuration of a divot repair tool 1102. The divot repair tool 1102 can include prongs 1104 and a blade 1105 attached to a tool base 1106 at a prong angle 1110.

The blade 1105 is a rounded plate element attached to the tool base 1106 and adjacent to the prongs 1104. The blade 1105 can provide a cutting element that can be used to cut through root structures beneath the playing surface 114 for improved penetration of the soil. For example, the blade 1105 can cut through stubborn roots or other growth to make the repair operation easier. The freed material cut by the blade 1105 can help support the playing surface 114.

The blade 1105 can be used to help leverage up a larger amount of soil to improve the repair operation. The blade 1105 can act as fulcrum or pivot point for the divot repair tool 1102 and offer a stronger interface between the playing surface 114 and the divot repair tool 1102. This can provide greater leverage and allow easier operation of the divot repair tool 1102. The blade 1105 can also improve the ability to shovel or move soil and other debris within the divot hole 112.

The prongs 1104 can be attached the tool base 1106 adjacent to or opposite to the blade 1105. The prongs 1104 can all be the same length or have different lengths.

The prongs 1104 and the blade 1105 can be configured to support rotation of the divot repair tool 1102. The prongs 1104 and the blade 1105 can be aligned around a rounded path along an edge of the divot repair tool 1102 to support a rotational action. The blade 1105 can be configured to be able to cut along the sides of the blade 1105 as well as on top of the blade 1105. Thus, the blade 1105 can cut through material when inserted into the playing surface 114 and when rotated within the playing surface 114.

The blade 1105 can also support a vertical levering action in operation. The divot repair tool 1102 can be inserted or pressed down into the divot hole 112 or into the playing surface 114. The blade 1105 can cut through the surface and then the blade 1105 can act as the pivot point to lever up material from below. The blade 1105 can be used to cut the playing surface 114 multiple times if necessary, to make a clear repair or to deal with extensive amounts of roots or other debris. The divot repair tool 1102 can be configured with different types of the prongs 1104 as needed including straight prongs, angled prongs, curved prongs, multi-bend prongs, and other similar prong shapes.

Although FIG. 11 shows three of the prongs 1104, it is understood that the divot repair tool 1102 can have any number of the prongs 1104. In addition, although only a single circumferential row of the prongs 1104 is shown, it is further understood that the divot repair tool 1102 can have between three and ten of the prongs 1104 arrange in one or more circular rows. In some embodiments, the divot repair tool 1102 can have ten or more of the prongs 1104. In other embodiments, the prongs 1104 can be arranged in other positional configurations as described in other sections of the specification.

The divot repair tool 1102 can also have different configurations of the blade 1105. The blade 1105 can have configurations that are curved, flat, sharpened, one-piece, multiple pieces, or other similar variations. In some embodiments, the blade 1105 can be positioned perpendicular to the circumference of the divot repair tool 1102. The blades 1105 can be formed from different materials such as metal, alloys, plastic, wood, ceramic, or a combination thereof.

Figure 12:
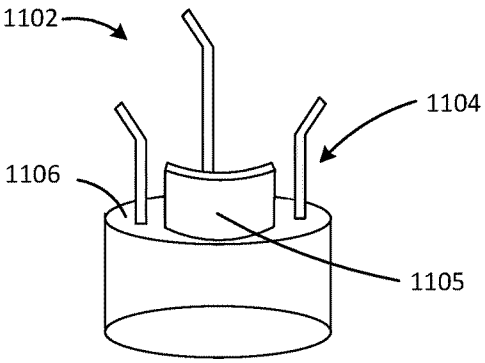
FIG. 12 depicts a side view of a curved blade configuration of a divot repair tool.

FIG. 12 illustrates a side view of a curved blade configuration of a divot repair tool 1102. The divot repair tool 1102 can include the prongs 1104 and the blade 1105 attached to the tool base 1106.

The prongs 1104 are shown having different lengths. The different lengths can provide additional functionality. Having a single longer one of the prongs 1104 can provide a guidance feature that makes it easier to position the divot repair tool 1102 within the divot hole 112. The single longer one of the prongs 1104 allows the player to more precisely position the divot repair tool 1102 and to quickly reposition the tool when needed. The other ones of the prongs 1104 can help lift or arrange the soil within the divot hole 112.

The blade 1105 can be configured in a variety of ways. The blade 1105 can be configured with a sharpened top or an unsharpened top. The blade 1105 can be configured with sharpened sides or unsharpened sides. In some configurations, the blade 1105 can be removed and replaced with one of the prongs 1104.

The blade 1105 can be formed from a variety of materials. For example, the blade 1105 can be metal, ceramic, plastic, an alloy, a composite material, wood, or other such materials of sufficient strength and rigidity.

The divot repair tool 1102 can have similar elements and properties as the other embodiments in the specification. Individual elements can be replaced as necessary based on the needs of the player.

3.2. Prongs

FIG. 13 illustrates an exemplary view of a single bend prong 1302. The single bend prong 1302 can have a prong body 1304 and a prong tip 1306. The prong tip 1306 can diverge from the prong body 1304 by a bend angle 1308.

The single bend prong 1302 can include a prong attachment element 1310 for attaching the single bend prong 1302 to the divot repair tool 302. The prong attachment element 1310 can include a screw tip, a post, a tapered post, a pin, a latch, or other structure attachment element. The prongs can be formed from different materials such as metal, alloys, plastic, wood, ceramic, or a combination thereof.

FIG. 14 illustrates an exemplary view of a multiple bend prong 1402. The multiple bend prong 1402 can have a prong body 1404, a prong tip 1406, and with a plurality of prong bends 1412. The prong bends 1412 can diverge from the prong body 1404 and provide increased contact area with the playing surface 114. The multiple bend prong 1402 can have any number of bends.

The multiple bend prong 1402 can include a prong attachment element 1410 for attaching the multiple bend prong 1402 to the divot repair tool 302. The prong attachment element 1410 can include a screw tip, a post, a tapered post, a pin, a latch, or other structure attachment element.

FIG. 15 illustrates an exemplary view of a three-dimensional multiple bend prong 1502 (3D multiple bend prong 1502). The 3D multiple bend prong 1502 can have a prong body 1504, a prong tip 1506, and a plurality of prong bends 1512. The prong bends 1512 can diverge from the prong body 1504 and provide increased contact area with the playing surface 114. The 3D multiple bend prong 1502 can have any number of bends. The prong bends 1512 can be in any direction or orientation and can extend in all three dimensions.

The 3D multiple bend prong 1502 can include a prong attachment element 1510 for attaching the 3D multiple bend prong 1502 to the divot repair tool 302. The prong attachment element 1510 can include a screw tip, a post, a tapered post, a pin, a latch, or other structure attachment element.

FIG. 16 illustrates an exemplary view of a spiral prong 1602. The spiral prong 1602 can have a prong body 1604 having a three-dimensional spiral structure similar to a corkscrew. The spiral prong 1602 can provide increased contact area with the playing surface 114 overall and locally in the location where the spiral prong 1602 is inserted. The spiral prong 1602 can include a prong tip 1606. The spiral prong 1602 can be used with other prongs or individually. In some embodiments, the spiral prong 1602 can rotate individually. The spiral prong 1602 can have any number of curved bends.

The spiral prong 1602 can include a prong attachment element 1610 for attaching the spiral prong 1602 to the divot repair tool 302. The prong attachment element 1610 can include a screw tip, a post, a tapered post, a pin, a latch, or other structure attachment element.

FIG. 17 illustrates an exemplary view of a straight prong 1702. The straight prong 1702 can have a prong body 1704 that extends out linearly with no bend. The straight prong 1702 can include a prong tip 1706. The straight prong 1702 can include a prong attachment element 1710 for attaching the straight prong 1702 to the divot repair tool 302. The prong attachment element 1710 can include a screw tip, a post, a tapered post, a pin, a latch, or other structure attachment element.

FIG. 18 illustrates an exemplary view of a curved prong 1802. The curved prong 1802 can have a prong body 1804 that extends out in a curved fashion. The curved prong 1802 can include a prong tip 1806. The curved prong 1802 can include a prong attachment element 1810 for attaching the curved prong 1802 to the divot repair tool 302. The prong attachment element 1810 can include a screw tip, a post, a tapered post, a pin, a latch, or other structure attachment element.

3.3. Blades

FIG. 19 illustrates an exemplary view of a curved blade 1902. The curved blade 1902 can have a blade body 1904 having a curved structure. The blade body 1904 can be flat or rounded on the top and sides. The curved blade 1902 can include a blade attachment element 1910 for attaching the curved blade 1902 to the divot repair tool 302. The blade attachment element 1910 can include a screw tip, a post, a tapered post, a pin, a latch, or other structure attachment element.

FIG. 20 illustrates an exemplary view of a sharpened curved blade 2002. The sharpened curved blade 2002 can have a blade body 2004 having a curved structure. The blade body 2004 can be sharpened on the top and sides. The sharpened curved blade 2002 can include a blade attachment element 2010 for attaching the sharpened curved blade 2002 to the divot repair tool 302. The blade attachment element 2010 can include a screw tip, a post, a tapered post, a pin, a latch, or other structure attachment element.

FIG. 21 illustrates an exemplary view of a flat blade 2102. The flat blade 2102 can have a blade body 2104 such as a plate structure. The blade body 2104 can be flat or rounded on the top and sides. The flat blade 2102 can include a blade attachment element 2110 for attaching the flat blade 2102 to the divot repair tool 302. The blade attachment element 2110 can include a screw tip, a post, a tapered post, a pin, a latch, or other structure attachment element.

FIG. 22 illustrates an exemplary view of a sharpened flat blade 2202. The sharpened flat blade 2202 can have a blade body 2204 having a flat structure and one or more sharpened edges on the top and sides. The sharpened flat blade 2202 can include a blade attachment element 2210 for attaching the sharpened flat blade 2202 to the divot repair tool 302. The blade attachment element 2210 can include a screw tip, a post, a tapered post, a pin, a latch, or other structure attachment element.

FIG. 23 illustrates an exemplary view of multiple blades 2302. The multiple blades 2302 can have a plurality of blade bodies 2304 each having a flat or curved structure overall. The multiple blades 2302 can have a flat top and sides or one or more sharpened edges on the top and sides as described above. Each of the blade bodies 2304 of the multiple blades 2302 can include a blade attachment element 2310 for attaching the blade bodies 2304 to the divot repair tool 302. The blade attachment element 2310 can include a screw tip, a post, a tapered post, a pin, a latch, or other structure attachment element.

FIG. 24 illustrates an exemplary view of a rounded blade 2402. The rounded blade 2402 can have a blade body 2404 having a flat or curved structure overall. The rounded blade 2402 can have an unsharpened top and sides or one or more sharpened edges on the top and sides. The rounded blade 2402 can include a blade attachment element 2410 for attaching the blade body 2404 to the divot repair tool 302. The blade attachment element 2410 can include a screw tip, a post, a tapered post, a pin, a latch, or other structure attachment element.

FIG. 25 illustrates an exemplary view of an angled blade 2502. The angled blade 2502 can have a blade body 2504 having a flat overall. The angled blade 2502 can have an unsharpened top and sides or one or more sharpened edges on the top and sides. The angled blade 2502 can include a blade attachment element 2510 for attaching the blade body 2504 to the divot repair tool 302. The blade attachment element 2510 can include a screw tip, a post, a tapered post, a pin, a latch, or other structure attachment element.

3.4. Automated Divot Repair Tool

Figure 26:
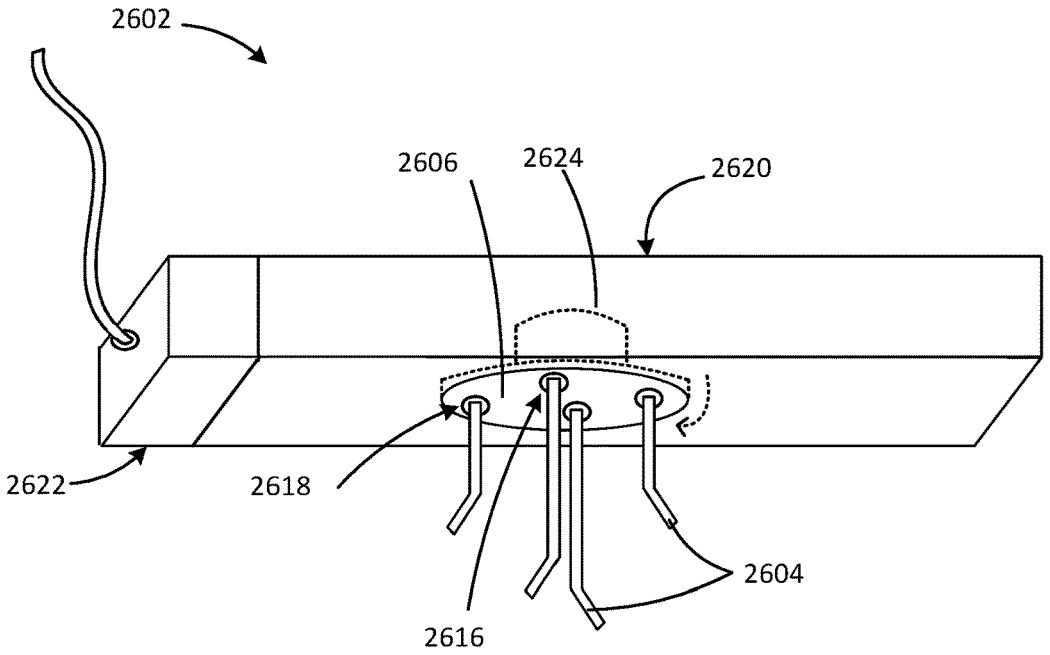
FIG. 26 depicts an example of an automated divot repair tool.

FIG. 26 illustrates an example of an automated divot repair tool 2602 in an embodiment. The automated divot repair tool 2602 is a powered tool for repairing divot holes in the playing surface 114. The tool can be placed on the divot hole 112 and activated.

The automated divot repair tool 2602 is a powered version having electric motors that can automatically rotate the prongs 2604 attached to a tool base 2606 to repair the divot hole 112. The automated divot repair tool 2602 can include a tool housing 2620 having a controller system 2622 and one or more motors and gearing systems to cause the rotation of the tool base 2606 after being activated by a user interface. The automated divot repair tool 2602 can be self-powered or coupled to an external power supply.

In an embodiment, the automated divot repair tool 2602 can be placed over the divot hole 112 and activated. Optionally, the player can implant the automated divot repair tool 2602 by pushing it into the playing surface 114 over the divot hole 112. The tool can be implanted by stepping on the housing, pushing it into the playing surface manually, or other similar techniques for implanting the tool.

When the automated divot repair tool 2602 is activated, the tool base 2606 can rotate to move the prongs 2604 and elevate the soil of the divot hole 112 and press it against the flat surface of the body of the tool housing 2620. This can form a flattened surface on the playing surface 114. The tool base 2606 can be rotated using a tool motor 2624.

In another embodiment, each of the prongs 2604 can be mounted on an individually rotating prong mount 2616. The rotating prong mount 2616 can be coupled to a prong motor 2618 that can rotate the individual prong to repair a portion of the playing surface 114. The prong motor 2618 and the tool motor 2624 can operate together or individually. The prongs 2604 can be any combination of the prongs and the blades described earlier. For example, the prongs 2604 can be configured as one or more of the single bend prongs 1302.

Figure 27:
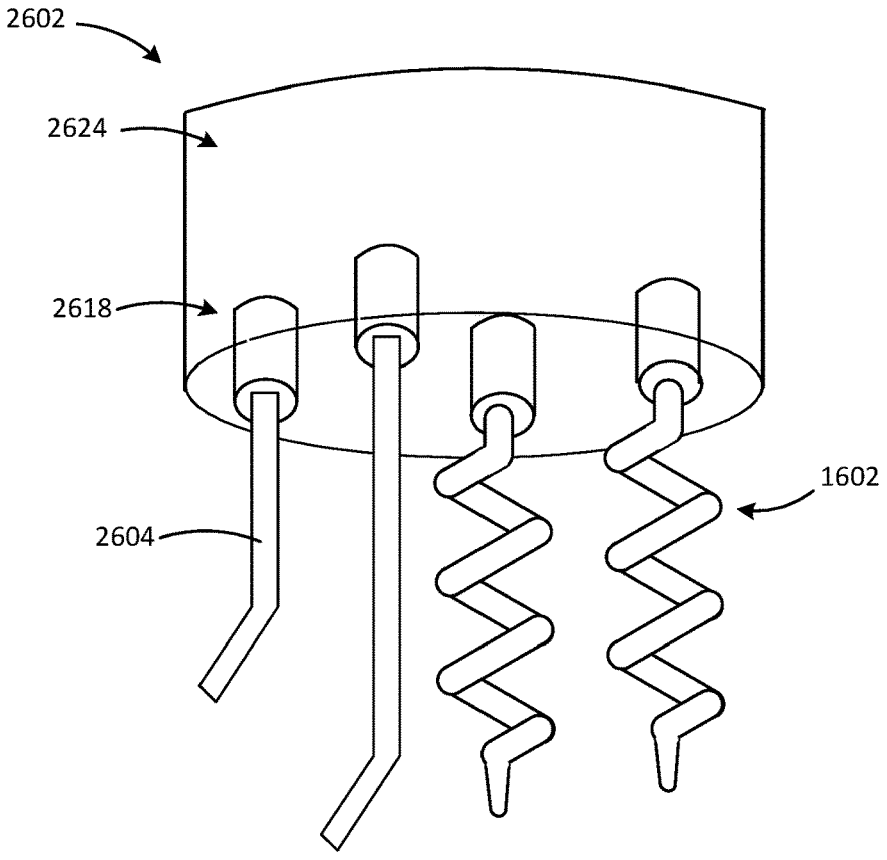
FIG. 27 depicts an example of detailed view of an automated divot repair tool.

FIG. 27 illustrates an example of detailed view of an automated divot repair tool 2602 in an embodiment. The automated divot repair tool 2602 is a powered tool for repairing divot holes in the playing surface 114.

The automated divot repair tool 2602 can include each of the prongs 2604 attached to a prong motor 2618. The prong motor 2618 is a motor for rotating each of the prongs 2604 to move soil to repair the playing surface 114. Each of the prong motors 2618 can operate individually. The prong motors 2618 can operate in parallel with the operation of the tool motor 2624. Thus, the automated divot repair tool 2602 can perform complex motions to repair the divot hole 112 in the playing surface 114.

In yet another embodiment, the prongs 2604 can include the spiral prong 1602. The prong motor 2618 can drive the plurality of the spiral prongs 1602 and the motion of the spiral prongs 1602 can help press the soil of the divot hole 112 up against the tool housing 2620 and flatten the playing surface 114.

When the playing surface 114 has been sufficiently repaired, the automated divot repair tool 2602 can be removed or it can operate the prong motors 2618 in reverse to facilitate detachment from the playing surface 114. Once the prongs are disengaged from the playing surface 114, the automated divot repair tool 2602 can be removed.

Figure 28:
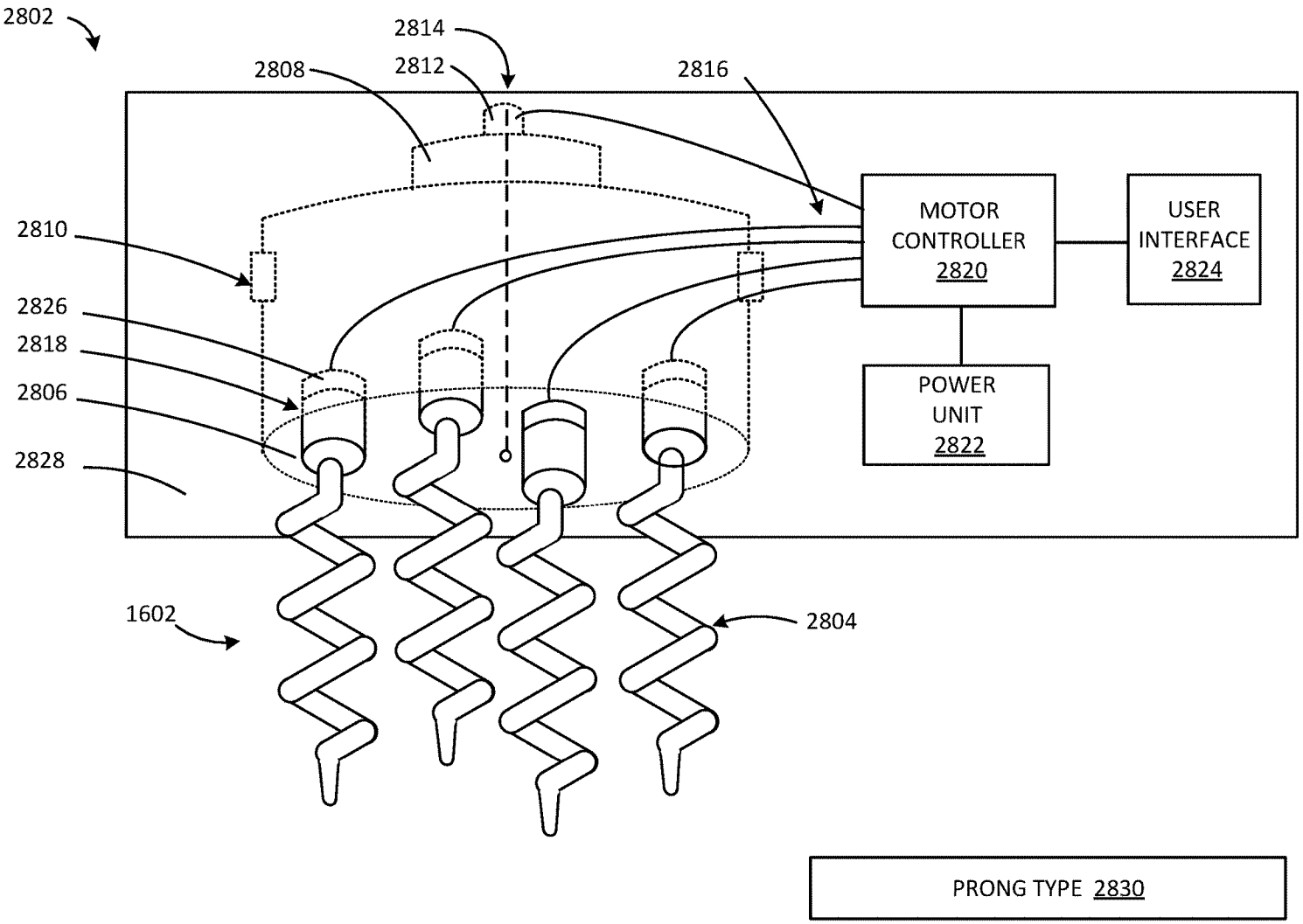
FIG. 28 depicts an example of detailed view of an automated divot repair tool.

FIG. 28 illustrates an example of a detailed view of an automated divot repair tool 2802 in another embodiment. The automated divot repair tool 2802 is a portable powered tool for repairing the divot holes 112 in the playing surface 114.

The automated divot repair tool 2802 can include components for controlling the tools, powering the tools, manipulating the soil of the divot hole 112, and disengaging after completion. For example, the automated divot repair tool 2802 can include prongs 2804, prong motors 2818, prong sensors 2826, a tool base 2806, a tool motor 2808, a motor controller 2820, a power unit 2822, a user interface 2824, controller connections 2816, and a tool housing 2828.

In an illustrative embodiment, the automated divot repair tool 2802 can be inserted into the divot hole 112, the prongs 2804 and the tool base 2806 can be rotated by the prong motors 2818 and the tool motor 2808 to drive the soil of the divot hole 112 up against the tool housing 2828 to repair the playing surface 114. The prongs 2804 can then be withdrawn from the repaired playing surface 114.

The prongs 2804 can be coupled to the prong motors 2818 which are controlled by the motor controller 2820. The prong motors 2818 can rotate the each of the prongs 2804 individually around the long axis of the prongs 2804. The prong motors 2818 can receive power from the power unit 2822. For example, the prongs 2804 can be spiral corkscrew prongs, such as the spiral prong 1602.

The automated divot repair tool 2802 can also include an integrated housing, such as a tool housing 2828, to protect the components of the tool while simultaneously providing a flat work surface to assist with the divot repair process. The prongs 2804 can be used to drive the underlying soil against the tool housing 2828 to flatten the divot hole 112.

The prong motors 2818, the prong sensors 2826, and the tool motor 2808 can be coupled to the motor controller 2820 with the controller connections 2816. The controller connection 2816 are conductors configured to carry control information and power from the motor controller 2820 and the power unit 2822, respectively. For example, the controller connection 2816 can be cables, conductors, multiple wires, ribbon cables, or other similar connection mechanisms.

The prong motors 2818 and the tool motor 2808 can have a variety of configurations. For example, the prong motors 2818 and the tool motor 2808 can be an electric motor, a stepper motor, a motion-controlled motor, or other similar motor.

The prong sensors 2826 are devices to monitor the operating conditions of the prong motors 2818. The prong sensors 2826 can be integrated into the prong motors 2818 or be attached to the prong motors 2818. The prong sensors 2826 can detect conditions of the prong motors 2818 such as position, orientation, rotation speed, number rotations, acceleration, jamming, mechanical load, power consumption, temperature, end conditions, and other similar parameters and conditions.

The prong sensors 2826 can also detect a prong type 2830 of the prongs 2804 that have been attached. The type detection can be based on an encoded radio-frequency identification tag (RFID), bar code, a surface marker on the prong, plug type, a surface or structural marker on the attachment element, measuring an inertial characteristic by spinning the prongs, or other similar techniques. The prong type 2830 can automatically determine how the motor controller 2820 operates the system. For example, if the prong sensors 2826 detect that all of the prongs 2804 have the prong type 2830 value of spiral prong, then the motor controller 2820 can operate by rotating the individual prongs in a circular motion and not rotate the tool base 2806. If the prong sensors 2826 detect the prongs 2804 are straight, curved, single bend, or other similar prong types, then the motor controller 2820 can operate the system by rotating the tool base 2806 and not rotating the prong motors 2818 individually.

For example, the prong sensors 2826 can detect when the prong motors 2818 have rotated the prongs 2804 far enough to press the soil and grass of the playing surface 114 against the tool housing 2828. This could occur when the prong sensors 2826 indicate no further rotation, additional resistance, slowing rotation, or other conditions.

The tool motor 2808 can be controlled by the motor controller 2820. The motor controller 2820 can be connected to a motor sensor 2812 with the controller connection 2816.

The tool motor 2808 can be coupled to tool base 2806 to rotate the tool base 2806 and the prongs 2804 in a large circular motion around a central axis 2814 of the tool base 2806. The tool motor 2808 can be directly attached to the tool base 2806, coupled by a gearing mechanism, coupled by a belt drive mechanism, or other similar coupling mechanisms.

The tool motor 2808 can be coupled to a motor sensor 2812. The motor sensor 2812 can detect conditions of the tool motor 2808 such as position, orientation, rotation speed, number rotations, acceleration, jamming, mechanical load, power consumption, temperature, end conditions, and other similar parameters and conditions.

The circular motion of the prongs 2804 rotating around the central axis 2814 of the tool base 2806 can move the soil of the divot hole 112 and flatten the playing surface 114 against the tool housing. The prongs 2804 can be configured to move the soil of the divot hole 112 based on the orientation, angle, position, prong tip configuration, and other similar properties.

The tool base rotation action can include the prongs 2804 configured to raise the soil in the divot hole 112 when all of the prongs 2804 are rotated with the tool base 2806. For example, the prongs 2804 can be single bend prongs, such as the single bend prong 1302, aligned with the prong bend pointing in the direction of the rotation. In another example, the prongs 2804 can be straight or curved prongs, such as the straight prong 1702 or the curved prong 1802. The prongs can be configured to work to lift the soil of the divot hole 112 when rotated in the direction of rotation of the tool base 2806.

The power unit 2822 can be an internal power supply, such as batteries, or it can be a power converter receiving power from an external source, such as an external battery pack. The power unit 2822 can be configured to process regular power consumption as well as high power consumption during circumstances such as the prongs 2804 stopping, jamming, encountering resistance in the soil, or other such circumstances. The power unit 2822 can be removeable or permanently installed in the tool housing. The power unit 2822 can be rechargeable or non-rechargeable.

The automated divot repair tool 2802 can include the user interface 2824 for controlling the tool. The user interface 2824 can have a variety of forms. For example, the user interface 2824 can be a simple switch, a smart phone application, an interactive control panel on the tool housing, a wired or wireless control unit, or other similar mechanisms.

The tool base 2806 can be attached to the tool housing 2828 using the mounting adapter 2810. The mounting adapter 2810 can be integrated within the tool housing 2828. For example, the mounting adapter 2810 can include a mechanical mounting bracket, an opening in the tool housing 2828, mounting tabs with attachment holes, screws, tabs, bolts, adhesive layers, fasteners, latches, or a combination thereof.

4.0. Functional Overview

Figure 29:
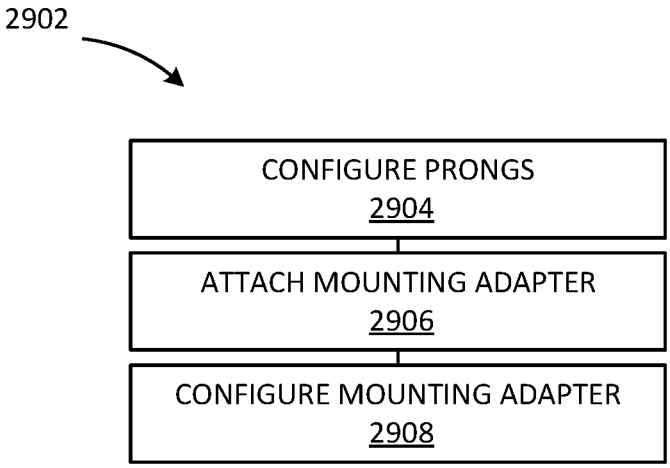
FIG. 29 depicts an example of a manufacturing process flow.

FIG. 29 illustrates an example of a manufacturing process flow 2902. The manufacturing process flow 2902 can describe the steps and process for forming the divot repair tool 402.

The manufacturing process flow 2902 can include a variety of operations. In an illustrative embodiment, the manufacturing process flow 2902 can include a configure prongs step 2904, an attach mounting adapter step 2906, and a configure mounting adapter step 2908.

In the configure prongs step 2904, the tool base 406 can be configured with the prongs 404. The tool base 406 can be fabricated by forming the tool base 406 using a variety of materials including metal, plastic, resin, ceramic, or other similar materials. The tool base 406 can be formed by a combination of molding, 3-dimensional (3D) printing, etching, milling, drilling, lathing, or other similar techniques. In some examples, the tool base 406 can be fabricated by a vendor. The tool base 406 is a framework element for attaching other components such as the prongs 404 and blades 1105. The tool base 406 is a mechanical element with sufficient rigidity to hold and secure the other components in place during operation of the divot repair tool 402.

The tool base 406 can be a reconfigurable platform for installing the prongs 404. The tool base 406 can include locations for attaching the prongs 404 which can be removable. The prongs 404 can be attached to the tool base 406 as needed.

The prongs 404 can be configured and attached to the tool base 406 at one end of the base. The prongs 404 can be selected based on the prong type 2830 desired. For example, the prong type 2830 can include a single bend prong, a multiple bend prong, a 3D multiple bend prong, a spiral prong, a straight prong, a curved prong, or a similar shaped prong.

The prongs 404 can be attached to the tool base 406 using the prong attachment element 1310. The prong attachment element 1310 can be a screw, post, peg, magnet, or other attachment element.

The tool base 406 can also include the blades 1105 as part of the prong configuration. One or more of the blades can be attached to the mounting surface of the tool base 406. The blades 1105 can include a curved blade, a straight blade, a flat blade, a sharpened blade, multiple blades, a rounded blade, an angled blade, or other similar blade types.

Once the prongs 404 or the blades 1105 are attached to the tool base 406, the next step can be performed.

In the attach mounting adapter step 2906, the mounting adapter 410 can be attached to the tool base 406. The mounting adapter 410 can allow the tool base 406 and the prongs 404 to be attached to the extension element 106 such as the golf club 106 or a pole unit.

The mounting adapter 410 can have a tool side mount for attaching to the tool base 406. The tool side mount can be a mounting plate, slots, screw, rivets, an adhesive layer, or other similar mechanisms for attaching two components together. In an embodiment, the tool base 406 and the mounting adapter 410 can be screwed, bolted, or riveted together.

In an embodiment, the tool base 406 can be attached to the mounting adapter 410 using an adhesive, an epoxy, a resin, or similar technique. In another embodiment the tool base 406 and the mounting adapter 410 can have a mechanical interlock that allows both components to be securely attached to one another. In yet another example, the mounting adapter 410 can include a sleeve or covering that can be extended over the body of the tool base 406.

Once the mounting adapter 410 has been attached to the tool base 406, the control flow can pass to the next step.

In the configure mounting adapter step 2908, the mounting adapter 410 can be configured to be attached to the extension element such as the golf club 106 or pole unit. This can include preparing the interior surface of the mounting adapter 410 for use by configuring the attachment mechanism 428 of the mounting adapter 410. The attachment mechanism 428 can securely hold the divot repair tool 402 on the golf club 106 including enabling the rotation prevention mechanism 408.

The attachment mechanism 428 can have a variety of configurations. For example, the attachment mechanism 428 can be the flexible sleeve 412, screws, rivets, mounting tabs, or other similar mechanisms.

In different embodiments, the attachment mechanism 428 can be the flexible sleeve 412 in different configurations. For example, the flexible sleeve 412 can be configured with an interior surface with adhesive properties. This can include an adhesive material layer, a roughened interior surface for improved frictional adhesion, or other similar adhesive techniques. In another example, the flexible sleeve 412 can be formed with a heavy elastic material, such as rubber, that can form a compression fit when installed on the golf club 106. In other embodiments, the adhesive layers can be applied in different patterns or thicknesses to modify the properties of the adhesion. This can include linear patterns, custom patterns, spiral patterns, gradient patterns, or a combination thereof. In some embodiments, the adhesive layers can include multiple different adhesive materials, different layers in different patterns, or other variations.

In another embodiment, the attachment mechanism 428 can include mounting plate and fasteners, gear latches, the mounting pin 422, or other similar mechanism. Configuring the mounting adapter 410 can include installing or attaching the attachment mechanism 428 to the mounting adapter 410.

Configuring the mounting adapter 410 can include configuring the rotation prevention mechanism 408. The rotation prevention mechanism 408 is a structure or device that can prevent or inhibit the rotation of the divot repair tool 402 around the extension element such as the golf club 106 or the pole unit. The rotation prevention mechanism 408 can support the transfer of rotational motion from the golf club 106 to the divot repair tool 402 with minimal losses due to slippage.

In an embodiment, the rotation prevention mechanism 408 can include the flexible sleeve 412 configured with the locking tabs 424 that can be used to form an interlock with the locking grooves 426 of the golf club 106. The locking tabs 424 can be linear structures attached to the interior surface 420 of the flexible sleeve 412. The locking tabs 424 can be attached using mechanical fasteners, adhesive, or other similar techniques.

In other embodiments, the rotation prevention mechanism 408 can include a pin lock, a tongue and groove element, a friction lock, screw, lock bar, an interlock device, or other similar mechanisms. Configuring the rotation prevention mechanism 408 can include attaching a pin lock attached with a threaded screw, a friction lock mechanism such as a cinching mechanism, a mechanical interlock device such as a geared wheel and toothed attachments, or a similar locking device. It is understood that other techniques not listed can be used for implementing a friction fit to prevent rotational motion or slippage.

After the mounting adapter 410 has been configured, the divot repair tool 402 is ready for use. The operational control flow can return to the first step for manufacturing additional one of the divot repair tools 402.

Figure 30:
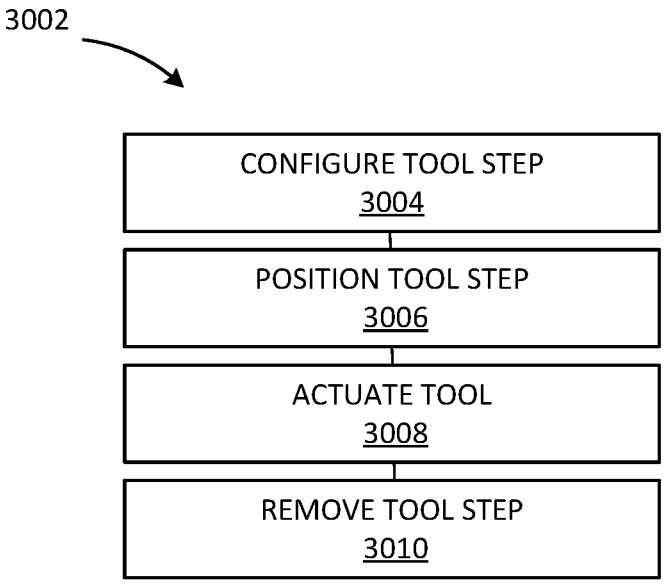
FIG. 30 depicts an example of an operation process flow.

FIG. 30 illustrates an example of an operating process flow 3002. The operating process flow 3002 describes how the divot repair tool 402 can be used.

The divot repair tool 402 can be used in operation to repair the playing surface 114 of a golf course after the play has resulted in the formation of the divot hole 112. The divot repair tool 402 can be used in several ways depending on the configuration of the tool. For example, the divot repair tool 402 can be used with a levering action to manipulate the soil of the divot hole 112 and flatten the playing surface 114. In another example, the divot repair tool 402 can be used with a rotational action to help level the playing surface. Other embodiments may use other actions when using the divot repair tool 402 to repair and flatten the playing surface 114.

The operating process flow 3002 can be performed in a variety of ways. For example, the operating process flow 3002 can include a configure tool step 3004, a position tool step 3006, an actuate tool step 3008, and a remove tool step 3010.

In the configure tool step 3004, the prongs 404 can be configured for the type of use desired and the divot repair tool 402 can be attached to the golf club 106 using the mounting adapter 410.

The configure tool step 3004 can include a final configuration of the prongs 404. The prongs 404 can be attached to the tool base 406. The prongs 404 can be attached using the prong attachment element, such as a screw, peg, pins, or other mechanisms. The selection of the prongs 404 can control the operation of the divot repair tool 402. For example, the prongs 404 can be configured to support a levering action, a rotational action, a sideways action, a rocking action, or a combination thereof. Configuring the prongs 404 can include mounting, aligning, orientating, or positioning the prongs 404.

In some embodiments, the prongs 404 can be configured as single bend prongs 1302 aligned in different ways with the same or different lengths. The single bend prongs 1302 can be aligned with the prong tips 1306 pointing in the same clockwise or counterclockwise directions, with the prong tips 1306 pointing in different direction, having pairs of the prongs pointing in different direction, or other similar orientations. Similarly, the single bend prongs 1302 can be substituted with the straight prongs 1702 or curved prongs 1802 and have similar performance and operational characteristics.

In another embodiment, the prongs 404 can be configured as multiple bend prongs 1402 with the same or different lengths. These prongs 404 can be configured to be used to manipulate the soil under the divot hole 112 using either a levering, rotational, sideways, or rocking action.

Configuring the prongs 404 can also include orientating the prongs 404 based on the handedness of the player. For rotational actions, the rotation of the divot repair tool 402 can be configured for a right-handed or left-handed player. The handedness of the player can determine the direction of rotation of the tool, such as clockwise or counterclockwise. Depending on the players need, the prongs 404 can be orientation to work in the desired rotational direction. This player preference may change during the play of the game and can be based on a variety of factors including time, weather, conditions, playing surface, or other operational and performance issues.

Attaching the mounting adapter 410 to the extension element, such as the golf club 106 or pole unit, can be performed in a variety of ways depending on the configuration of the mounting adapter 410. In one embodiment, the mounting adapter 410 can include the flexible sleeve 412 and can be attached to the grip 116 by opening or rolling back the portion of the flexible sleeve 412 to allow the grip 116 to be inserted into eh flexible sleeve 412. The presence of an adhesive layer, an adhesive pattern, or adhesive elements can be included to improve the stability of the attachment of the mounting adapter 410. In another embodiment, attaching the mounting adapter 410 can be attached to the extension element, such as the golf club 106 or the pole unit, using fasteners, such as screw, bolts, rivets, pins, or other similar elements.

When the flexible sleeve 412 includes the rotation prevention mechanism 408 configured as the locking tabs 424 and the golf club 106 includes the locking grooves 426, the attaching the flexible sleeve 412 can include aligning the locking tabs 424 with the locking grooves 426 before installation. In an embodiment where the rotation prevention mechanism 408 is a screw lock, then installation can include the process of aligning a screw hole with the lock screw and using the lock screw to secure the two components.

When the configure tool step 3004 is complete, the operational flow can pass to the position tool step 3006.

In the position tool step 3006, the divot repair tool 402 can be operated by positioning the prongs 404 on and in the divot hole 112. The divot 104 can optionally be replaced in the divot hole 112 to improve the quality of the repair. However, it is understood that even without the divot 104, the divot repair tool 402 can improve the relative flatness of the playing surface 114.

In some embodiments, the prongs 404 can be inserted deeper into the divot hole 112 by applying pressure with the golf club 106 or the pole unit. In the case of the automated divot repair tool 2602, the player can step on the tool housing 2828 to drive insert the prongs 404 deeper into the soil. Depending on the actual playing conditions, the prongs 404 can also be inserted adjacent to the divot hole 112. This can be the case when the divot hole 112 is small, the playing surface is soft or wet, or the prongs 404 are long relative to the hole.

In the actuate tool step 3008, the divot repair tool 402 can be used by the player to repair the divot hole 112. The divot repair tool 402 can be operated in a variety of ways. In one embodiment, the divot repair tool 402 can use a levering action to pry up soil to help flatten the playing surface 114. Once the prongs 404 have been inserted under the soil, the levering action can move the soil upward to flatten the playing surface 114.

In another embodiment, the divot repair tool 402 can employ a rotational action to turn the prongs 404 and drive up the soil in a corkscrew-like motion. The rotational action can push flatten the playing surface 114.

In yet another example, the divot repair tool 402, such as the automated divot repair tool 2802 configured with the spiral prongs 1602, can rotate the individual prongs using the prong motors 2618 to use a corkscrew-like motion to drive up the soil. The individual prongs can rotate and flatten the playing surface 114.

In the remove tool step 3010, the player can remove the divot repair tool 402. In the case where the prongs 404 are configured for a levering action, the divot repair tool 402 can simply be removed by detaching the tool from the repaired playing surface. In the case where the prongs 404 are configured to accommodate a rotational action, the divot repair tool 402 can be actuated in reverse to remove the prongs 404 from the playing surface 114 in such a way to minimize any further disturbance of the soil. This can include rotating the prongs 404 in reverse, rotating the tool base 406 in reverse, or a combination thereof.

Other examples of these and other embodiments are found throughout this disclosure.

5.0. Example Embodiments

Examples of some embodiments are represented, without limitation, in the following clauses and use cases:

According to an embodiment, a method of manufacture of a divot repair tool comprising attaching prongs to a tool base, the prongs configured for repairing a grass playing surface, attaching a mounting adapter to the tool base, and configuring the mounting adapter for attaching to an extension element, the mounting adapter configured with a rotation prevention mechanism to inhibit rotational slipping.

In an embodiment, the method further comprises attaching the prongs includes attaching removable prongs to the tool base and the removeable prongs include at least one of a straight prong, a curved prong, a single bend prong, a multiple bend prong, a three-dimensional multiple bend prong, and a spiral prong.

In an embodiment, the method further comprises the prongs include one prong having a longer prong length than one other prong.

In an embodiment, the method further comprises the mounting adapter includes a flexible sleeve configured to attach to the extension element.

In an embodiment, the method further comprises configuring the mounting adapter includes the mounting adapter having a rail configured to insert into a mating slot on the extension element for preventing rotational motion between the mounting adapter and the extension element.

In an embodiment, the method further comprises attaching a blade to the tool base and wherein attaching the blade includes attaching a flat blade, a curved blade, a sharpened blade, a rounded blade, or an angular blade.

In an embodiment, the method further comprises attaching the prongs includes attaching the prongs to a prong motor for rotating one of the prongs.

According to an embodiment, a method of operation of a divot repair tool comprising attaching a divot repair tool to an extension element with a mounting adapter, the prongs configured for repairing a grass playing surface, the prongs attached to a tool base, the tool base attached to the mounting adapter, and inserting a locking tab of the mounting adapter into a locking groove on the pole to prevent rotational motion between the mounting adapter and the pole.

In an embodiment, the method further comprises the prongs are configured as removable prongs and include at least one of a straight prong, a curved prong, a single bend prong, a multiple bend prong, a three-dimensional multiple bend prong, and a spiral prong.

In an embodiment, the method further comprises the prongs are configured having one prong with a longer prong length than one other prong.

In an embodiment, the method further comprises the mounting adapter is configured as a flexible sleeve for attaching to the extension element.

In an embodiment, the method further comprises the locking tab is configured as a vertical rail configured to fit into the locking groove on the extension element.

In an embodiment, the method further comprises attaching a blade to the tool base and wherein the blade is one of a flat blade, a curved blade, a sharpened blade, a rounded blade, or an angular blade.

In an embodiment, the method further comprises attaching the prongs includes attaching the prongs to a prong motor for rotating one of the prongs.

According to an embodiment, a divot repair tool comprising one or more prongs attached to a tool base, the prongs configured for repairing a grass playing surface, a mounting adapter attached to the tool base, and the mounting adapter configured for attaching to an extension element and the mounting adapter having a rotation prevention mechanism.

In an embodiment, the apparatus further comprises the prongs are configured as removable prongs and include at least one of a straight prong, a curved prong, a single bend prong, a multiple bend prong, a three-dimensional multiple bend prong, and a spiral prong.

In an embodiment, the apparatus further comprises the prongs are configured having one prong with a longer prong length than one other prong.

In an embodiment, the apparatus further comprises the mounting adapter is configured as a flexible sleeve for attaching to the extension element.

In an embodiment, the apparatus further comprises the locking tab is configured as a vertical rail configured to fit into the locking groove on the extension element.

In an embodiment, the apparatus further comprises attaching a blade to the tool base and wherein the blade is one of a flat blade, a curved blade, a sharpened blade, a rounded blade, or an angular blade.

6.0. Extensions and Alternatives

As used herein, the terms "first," "second," "certain," and "particular" are used as naming conventions to distinguish queries, plans, representations, steps, objects, devices, or other items from each other, so that these items may be referenced after they have been introduced. Unless otherwise specified herein, the use of these terms does not imply an ordering, timing, or any other characteristic of the referenced items.

In the drawings, the various components are depicted as being communicatively coupled to various other components by arrows. These arrows illustrate only certain examples of information flows between the components. Neither the direction of the arrows nor the lack of arrow lines between certain components should be interpreted as indicating the existence or absence of communication between the certain components themselves. Indeed, each component may feature a suitable communication interface by which the component may become communicatively coupled to other components as needed to accomplish any of the functions described herein.

In the specification, embodiments of the invention have been described with reference to numerous specific details that may vary from implementation to implementation. Thus, the sole and exclusive indicator of what is the invention and is intended by the applicants to be the invention, is the set of claims that issue from this application, in the specific form in which such claims issue, including any subsequent correction. In this regard, although specific claim dependencies are set out in the claims of this application, it is to be noted that the features of the dependent claims of this application may be combined as appropriate with the features of other dependent claims and with the features of the independent claims of this application, and not merely according to the specific dependencies recited in the set of claims. Moreover, although separate embodiments are discussed herein, any combination of embodiments and/or partial embodiments discussed herein may be combined to form further embodiments.

Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

It is understood that the system functionality can be described using terms like module, unit, system, subsystem, and component that represent devices that can be implemented using different combinations of hardware, firmware, and software elements. The devices can include electric subsystems, optical subsystems, mechanical subsystems, and other physical elements. These elements can include computing elements that can execute the firmware and software of the system.

What is claimed is:

1. A method of manufacture of a divot repair tool comprising:

attaching prongs to a tool base, the prongs configured for repairing a playing surface;

attaching a mounting adapter to the tool base;

attaching a mounting disk to an extension element, the mounting disk having a notch, the extension element having a grip for holding the extension element; and configuring the mounting adapter for attaching to the extension element, the mounting adapter configured to inhibit rotational slipping of the mounting adapter around the extension element, the mounting adapter having a locking tab on the inside of the mounting adapter, the extension element having a locking groove on the outside of the grip, and the locking tab for engaging in both the notch of the mounting disk and the locking groove.

2. The method as claimed in claim 1 wherein attaching the prongs includes attaching removable prongs to the tool base and the removeable prongs include at least one of a straight prong, a curved prong, a single bend prong, a multiple bend prong, a three-dimensional multiple bend prong, and a spiral prong.

3. The method as claimed in claim 1 wherein the prongs include one prong having a longer prong length than one other prong.

4. The method as claimed in claim 1 wherein the mounting adapter includes a flexible sleeve configured to attach to the extension element.

5. The method as claimed in claim 1 configuring the mounting adapter includes the mounting adapter having a rail configured to insert into a mating slot on the extension element for preventing rotational motion between the mounting adapter and the extension element.

6. The method as claimed in claim 1 further comprising attaching a blade to the tool base and wherein attaching the blade includes attaching a flat blade, a curved blade, a sharpened blade, a rounded blade, or an angular blade.

7. The method as claimed in claim 1 wherein attaching the prongs includes attaching the prongs to a prong motor for rotating at least one of the prongs.

8. A method of operation of a divot repair tool comprising:

attaching one or more prongs to a tool base with a mounting adapter, the prongs configured for repairing a grass playing surface, the prongs attached to the tool base, the tool base attached to the mounting adapter;

attaching a mounting disk to an extension element, the mounting disk having a notch, the extension element having a grip for holding the extension element; and inserting a locking tab of the mounting adapter into a locking groove on the outside of the grip of the extension element and into the notch of the mounting disk to inhibit rotational motion between the mounting adapter and the extension element.

9. The method as claimed in claim 8 wherein the prongs are configured as removable prongs and include at least one of a straight prong, a curved prong, a single bend prong, a multiple bend prong, a three-dimensional multiple bend prong, and a spiral prong.

10. The method as claimed in claim 8 wherein the prongs are configured having one prong with a longer prong length than one other prong.

11. The method as claimed in claim 8 wherein the mounting adapter is configured as a flexible sleeve for attaching to the extension element.

12. The method as claimed in claim 8 wherein the locking tab is configured as a vertical rail configured to fit into the locking groove on the extension element.

13. The method as claimed in claim 8 further comprising attaching a blade to the tool base and wherein the blade is one of a flat blade, a curved blade, a sharpened blade, a rounded blade, or an angular blade.

14. The method as claimed in claim 8 wherein attaching the prongs includes attaching the prongs to a prong motor for rotating at least one of the prongs.

15. A divot repair tool comprising:

one or more prongs attached to a tool base, the prongs configured for repairing a grass playing surface, a mounting adapter attached to the tool base;

an extension element having a mounting disk attached, the mounting disk having a notch, and the extension element having a grip for holding the extension element; and the mounting adapter having a locking tab on the inside of the mounting adapter, the extension element having a locking groove on the outside of the grip, and the locking tab for engaging in both the notch of the mounting disk and the locking groove for resisting rotational slipping around the extension element.

16. The apparatus as claimed in claim 15 wherein the prongs are configured as removable prongs and include at least one of a straight prong, a curved prong, a single bend prong, a multiple bend prong, a three-dimensional multiple bend prong, and a spiral prong.

17. The apparatus as claimed in claim 15 wherein the prongs are configured having one prong with a longer prong length than one other prong.

18. The apparatus as claimed in claim 15 wherein the mounting adapter is configured as a flexible sleeve for attaching to the extension element.

19. The apparatus as claimed in claim 15 wherein the locking tab is configured as a vertical rail configured to fit into the locking groove on the extension element.

20. The apparatus as claimed in claim 15 further comprising attaching a blade to the tool base and wherein the blade is one of a flat blade, a curved blade, a sharpened blade, a rounded blade, or an angular blade.

* * * * *